US007681635B2

(12) United States Patent
Farabee et al.

(10) Patent No.: US 7,681,635 B2
(45) Date of Patent: Mar. 23, 2010

(54) METHODS OF FRACTURING SENSITIVE FORMATIONS

(75) Inventors: Leldon Mark Farabee, Houston, TX (US); Ruben A. Alba, Henderson, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 131 days.

(21) Appl. No.: 11/221,544

(22) Filed: Sep. 8, 2005

(65) Prior Publication Data

US 2006/0000610 A1 Jan. 5, 2006

Related U.S. Application Data

(63) Continuation-in-part of application No. 10/807,986, filed on Mar. 24, 2004, now Pat. No. 7,225,869.

(51) Int. Cl.
*E21B 43/114* (2006.01)

(52) U.S. Cl. ..... 166/177.5; 166/281; 166/284; 166/308.1

(58) Field of Classification Search ..... 166/279, 166/289, 280.1, 281, 282, 284, 308, 308.1, 166/177.5
See application file for complete search history.

(56) References Cited

U.S. PATENT DOCUMENTS

| | | | | |
|---|---|---|---|---|
| 2,758,653 A | | 8/1956 | Desbrow | |
| 2,859,822 A | * | 11/1958 | Wright | 166/281 |
| 3,251,993 A | | 5/1966 | Bader et al. | |
| 3,664,422 A | | 5/1972 | Bullen | |
| 3,712,379 A | | 1/1973 | Hill | |
| 4,346,761 A | | 8/1982 | Skinner et al. | |
| 4,524,825 A | | 6/1985 | Fore | 166/139 |

(Continued)

FOREIGN PATENT DOCUMENTS

| | | |
|---|---|---|
| EP | 0427371 | 5/1991 |

(Continued)

OTHER PUBLICATIONS

U.S. Appl. No. 10/807,986, filed Mar. 24, 2004, Willett, et al.

(Continued)

*Primary Examiner*—Jennifer H Gay
*Assistant Examiner*—Brad Harcourt
(74) *Attorney, Agent, or Firm*—Robert A. Kent; Baker Botts LLP

(57) ABSTRACT

An example of a method includes providing a hydrajetting tool in a well bore in a formation; injecting a fluid through the tool into a first region of the formation at a velocity sufficient to form one or more perforation tunnels; maintaining the flow of fluid into the perforation tunnels at a pressure greater than the fracture closure pressure, so as to create one or more fractures in the first region; plugging at least partially the fractures with an isolation fluid; injecting a fluid through the hydrajetting tool into a second region of the formation at a velocity sufficient to form one or more perforation tunnels in the second region; and maintaining the flow of fluid into the perforation tunnels in the second region at a pressure greater than the fracture closure pressure, so as to create one or more fractures in the second region.

18 Claims, 17 Drawing Sheets

U.S. PATENT DOCUMENTS

| | | | | |
|---|---|---|---|---|
| 4,590,995 | A | 5/1986 | Evans | 166/127 |
| 4,627,491 | A | 12/1986 | Zunkel | 166/126 |
| 4,697,640 | A | 10/1987 | Szarka | 166/120 |
| 4,808,925 | A | 2/1989 | Baird | 324/221 |
| 4,951,751 | A | 8/1990 | Jennings, Jr. | 166/285 |
| 4,962,815 | A | 10/1990 | Schultz et al. | 166/387 |
| 5,117,912 | A | 6/1992 | Young | 166/305.1 |
| 5,330,005 | A | 7/1994 | Card et al. | 166/280 |
| 5,361,856 | A | 11/1994 | Surjaatmadja et al. | 175/67 |
| 5,363,919 | A | 11/1994 | Jennings, Jr. | 166/308 |
| 5,381,864 | A | 1/1995 | Nguyen et al. | 166/280 |
| 5,406,078 | A | 4/1995 | Jacobson | 250/261 |
| 5,439,055 | A | 8/1995 | Card et al. | 166/280 |
| 5,494,103 | A | 2/1996 | Surjaatmadja et al. | 166/222 |
| 5,499,678 | A | 3/1996 | Surjaatmadja et al. | 166/298 |
| 5,501,275 | A | 3/1996 | Card et al. | 166/280 |
| 5,701,954 | A | 12/1997 | Kilgore et al. | 166/119 |
| 5,703,286 | A | 12/1997 | Proett et al. | 73/152.05 |
| 5,743,334 | A | 4/1998 | Nelson | 166/250.07 |
| 5,765,642 | A | 6/1998 | Surjaatmadja | 166/297 |
| 5,775,415 | A | 7/1998 | Yoshimi | 165/202 |
| 5,787,986 | A | 8/1998 | Weaver et al. | 166/280 |
| 5,833,000 | A | 11/1998 | Weaver et al. | 166/276 |
| 5,839,510 | A | 11/1998 | Weaver et al. | 166/276 |
| 5,853,048 | A | 12/1998 | Weaver et al. | 166/279 |
| 5,871,049 | A | 2/1999 | Weaver et al. | 166/276 |
| 5,890,536 | A | 4/1999 | Nierode et al. | |
| 5,899,958 | A | 5/1999 | Dowell et al. | 702/6 |
| 5,934,377 | A | 8/1999 | Savage | 166/281 |
| 5,941,308 | A | 8/1999 | Malone et al. | 166/313 |
| 6,006,838 | A | 12/1999 | Whiteley et al. | 166/306 |
| 6,012,525 | A | 1/2000 | Burleson et al. | 166/297 |
| 6,047,772 | A | 4/2000 | Weaver et al. | 166/276 |
| 6,056,052 | A | 5/2000 | Mullen et al. | 166/134 |
| 6,070,666 | A | 6/2000 | Montgomery | 166/308 |
| 6,116,343 | A | 9/2000 | Van Petegem et al. | 166/297 |
| 6,186,230 | B1 | 2/2001 | Nierode | |
| 6,230,805 | B1 | 5/2001 | Vercaemer et al. | 166/300 |
| 6,257,338 | B1 | 7/2001 | Kilgore | 166/387 |
| 6,286,598 | B1 | 9/2001 | Van Petegem et al. | 166/297 |
| 6,286,599 | B1 | 9/2001 | Surjaatmadja et al. | 166/298 |
| 6,286,600 | B1 | 9/2001 | Hall et al. | 166/305.1 |
| 6,296,066 | B1 | 10/2001 | Terry et al. | 175/92 |
| 6,306,800 | B1 | 10/2001 | Samuel et al. | 507/129 |
| 6,394,184 | B2 | 5/2002 | Tolman et al. | 166/281 |
| 6,446,727 | B1 | 9/2002 | Zemlak et al. | 166/308 |
| 6,474,419 | B2 | 11/2002 | Maier et al. | 166/387 |
| 6,488,091 | B1 | 12/2002 | Weaver et al. | 166/300 |
| 6,494,260 | B2 | 12/2002 | Van Petegem et al. | 166/278 |
| 6,497,284 | B2 | 12/2002 | Van Petegem et al. | 166/297 |
| 6,508,307 | B1 | 1/2003 | Almaguer | 166/308 |
| 6,520,255 | B2 | 2/2003 | Tolman et al. | 166/281 |
| 6,543,538 | B2 | 4/2003 | Tolman et al. | 166/284 |
| 6,547,011 | B2 | 4/2003 | Kilgore | 166/387 |
| 6,554,075 | B2 | 4/2003 | Fikes et al. | 166/379 |
| 6,581,699 | B1 | 6/2003 | Chen et al. | 175/61 |
| 6,601,646 | B2 | 8/2003 | Streich et al. | 166/278 |
| 6,604,581 | B2 | 8/2003 | Moake et al. | 166/250.07 |
| 6,613,720 | B1 | 9/2003 | Feraud et al. | 507/200 |
| 6,632,778 | B1 | 10/2003 | Ayoub et al. | 507/202 |
| 6,644,110 | B1 | 11/2003 | Curtis et al. | 73/152.51 |
| 6,662,874 | B2 | 12/2003 | Surjaatmadja et al. | 166/308 |
| 6,667,280 | B2 | 12/2003 | Chang et al. | 507/240 |
| 7,017,665 | B2 | 3/2006 | Nguyen | |
| 7,114,567 | B2 | 10/2006 | Chan et al. | |
| 7,225,869 | B2 | 6/2007 | Willet et al. | |
| 2002/0007949 | A1 | 1/2002 | Tolman et al. | |
| 2004/0206504 | A1 | 10/2004 | Rosato | 166/298 |
| 2005/0252659 | A1 | 11/2005 | Sullivan et al. | |
| 2008/0110622 | A1 | 5/2008 | Willett | |

FOREIGN PATENT DOCUMENTS

| | | |
|---|---|---|
| EP | 0823538 | 2/1998 |
| SU | 138554 | 9/1960 |
| SU | 147156 | 6/1961 |
| SU | 678181 | 8/1979 |
| WO | WO2005090747 | 9/2005 |

OTHER PUBLICATIONS

Knowlton, et al., *Depth Control for Openhole Frac Procedure, SPE 21294,* Society of Petroleum Engineers, 1990.

Hewett, et al, *Induced Stress Diversion: A Novel Approach to Fracturing Multiple Pay Sands of the NBU Field, Uintah Co.,* Utah, *SPE 39945,* Society of Petroleum Engineers, 1998.

Connell, et al, *Development of a Wireless Coiled Tubing Collar Locator, SPE 54327,* Society of Petroleum Engineers, 1999.

Connell, et al, *High-Pressure/High-Temperature Coiled Tubing Casing Collar Locator Provides Accurate Depth Control for Single-Trip Perforating, SPE 60698,* Society of Petroleum Engineers, 2000.

McConkey, et al, *Integration of Conventional Fracturing, Coiled Tubing, and Retrievable Tool Technology, SPE 60709,* Society of Petroleum Engineers, 2000.

Rodvelt, et al, *Multiseam Coal Stimulation Using Coiled-Tubing Fracturing and a Unique Bottomhole Packer Assembly, SPE 72380,* Soceity of Petroleum Engineers, 2001.

Flowers, et al, *Solutions to Coiled Tubing Depth Control, SPE 74833,* Society of Petroleum Engineers, 2002.

Cobra Jet VCA Acid Stimulation Recommendation dated Apr. 22, 2003.

Halliburton, *Cobra Frac$^{SM}$Service, Coiled Tubing Fracturing—Cost-Effective Method for Stimulating Untapped Reserves, HO2319R,* published 2000, Halliburton Energy Services, Inc.

Halliburton, *CobraJet Frac$^{SM}$Service, Cost-Effective Technology That Can Help Reduce Cost Per BOE Produced, Shorten Cycle Time and Reduce Capex,* published Halliburton Communications.

Norris, et al., *Multiple Proppant Fracturing of Horizontal Wellbores in a Chalk Formation: Evolving the Process in the Valhall Field,* SPE 50608, Society of Petroleum Engineers, 1998.

Granger, et al., *Horizontal Well Applications in the Guymon-Hugoton Field: A Case Study,* SPE 35641, Society of Petroleum Engineers, 1995.

"SurgiFrac$^{SM}$Service Fracture Stimulation Technique for Horizontal Completions in Low-to Medium-Permeability Reservoirs", Halliburton Communications.

Foreign communication from related counterpart application dated Jun. 16, 2005.

Notice of Allowance from related counterpart U.S. Appl. No. 10/807,986 dated Apr. 10, 2007.

Office Action from related counterpart U.S. Appl. No. 10/807,986 dated Jan. 24, 2007.

Office Action from related counterpart U.S. Appl. No. 10/807,986 dated Aug. 31, 2006.

Office Action from related counterpart U.S. Appl. No. 10/807,986 dated Apr. 4, 2004.

Office Action from related counterpart U.S. Appl. No. 10/807,986 dated Nov. 16, 2005.

Office Action from related counterpart U.S. Appl. No. 11/739,188 dated Jul. 11, 2008.

Office Action for U.S. Appl. No. 11/739,188, dated Jan. 12, 2009.

Decision to Grant for Russian Patent Application No. 2006137362, dated Jun. 17, 2009.

Office Action for U.S. Appl. No. 11/739,188, dated Oct. 2, 2009.

* cited by examiner

METHODS OF FRACTURING SENSITIVE FORMATIONS

CROSS-REFERENCE TO RELATED APPLICATION

This application is a continuation-in-part of U.S. patent application Ser. No. 10/807,986, entitled "Methods of Isolating Hydrajet-stimulated Zones," filed Mar. 24, 2004, now U.S. Pat. No. 7,225,869 incorporated by reference herein for all purposes, from which priority is claimed pursuant to 35 U.S.C. § 120.

BACKGROUND OF THE INVENTION

The present invention relates generally to subterranean treatment operations, and more particularly to methods of fracturing sensitive subterranean formations.

In some wells, it may be desirable to individually and selectively create multiple fractures along a well bore at a distance apart from each other. The multiple fractures should have adequate conductivity, so that the greatest possible quantity of hydrocarbons in an oil and gas reservoir can be drained/produced into the well bore. When stimulating a reservoir from a well bore, especially those well bores that are highly deviated or horizontal, it may be difficult to control the creation of multi-zone fractures along the well bore without cementing a liner to the well bore and mechanically isolating the subterranean formation being fractured from previously-fractured formations, or formations that have not yet been fractured.

One conventional method for fracturing a subterranean formation penetrated by a well bore has involved cementing a solid liner in the lateral section of the well bore, performing a conventional explosive perforating step, and then performing fracturing stages along the well bore, using some technique for mechanically isolating the individual fractures. Another conventional method has involved cementing a liner and significantly limiting the number of perforations, often using tightly-grouped sets of perforations, with the number of total perforations intended to create a flow restriction giving a back-pressure of about 100 psi or more; in some instances, the back-pressure may approach about 1000 psi flow resistance. This technology generally is referred to as "limited-entry" perforating technology.

In one conventional method of fracturing, a first region of a formation is perforated and fractured, and a sand plug then is installed in the well bore at some point above the fracture, e.g., toward the heel. The sand plug may restrict any meaningful flow to the first region of the formation, and thereby may limit the loss of fluid into the formation, while a second, upper portion of a formation is perforated and fracture-stimulated. Coiled tubing may be used to deploy explosive perforating guns to perforate subsequent treatment intervals while maintaining well control and sand-plug integrity. Conventionally, the coiled tubing and perforating guns are removed from the well before subsequent fracturing stages are performed. Each fracturing stage may end with the development of a sand plug across the perforations by increasing the sand concentration and simultaneously reducing pumping rates until a bridge is formed. Increased sand plug integrity may be obtained by performing what is commonly known in the cementing services industry as a "hesitation squeeze" technique. A drawback of this technique, however, is that it requires multiple trips to carry out the various stimulation and isolation steps.

The pressure required to continue propagation of a fracture present in a subterranean formation may be referred to as the "fracture propagation pressure." Conventional perforating operations and subsequent fracturing operations undesirably may cause the pressure to which the subterranean formation is exposed to fall below the fracture propagation pressure for a period of time. In certain embodiments of conventional perforating and fracturing operations, the formation may be exposed to pressures that oscillate above and below the fracture propagation pressure. For example, if a hydrojetting operation is halted temporarily, e.g., in order to remove the hydrojetting tool, or to remove formation cuttings from the well bore before continuing to pump the fracturing fluid, then the formation may experience a pressure cycle.

Pressure cycling may be problematic in sensitive formations. For example, certain subterranean formations may shatter upon exposure to pressure cycling during a fracturing operation, which may result in the creation of numerous undesirable microfractures, rather than one dominant fracture. Still further, certain conventional perforation operations (e.g., perforations performed using wireline tools) often may damage a sensitive formation, shattering it in the area of the perforation so as to reduce the likelihood that subsequent fracturing operations may succeed in establishing a single, dominant fracture.

Similarly, when a subterranean formation is perforated by, e.g., explosive devices, a high amount of compressive force may be imparted to the formation, which may cause a sharp increase (e.g., a "spike") in pressure. Such pressure spike may significantly damage the formation. To assist in overcoming the damage that may ensue from such pressure spike, techniques such as overbalanced perforating have been employed. In overbalanced perforating, the well bore is pressurized such that the perforation of the formation causes fractures to be formed in the formation at least a short distance from the well bore. However, even techniques such as overbalanced perforating may be problematic, and may lead to pressure cycling of the formation. Often, immediately after the perforation of the formation (e.g., immediately after detonation of the explosive devices), operators may have difficulty increasing the flowrate of fluid to be injected into the formation to an amount sufficient to maintain the fracture, which may cause the well bore pressure to fall, at least briefly, below the fracture propagation pressure. Additionally, where perforation is accomplished by detonation of explosive devices, such explosive devices often are capable of generating substantially greater compressive forces than those that may be reached by injection of a fracturing fluid into the formation. This may result in pressure cycling, as the formation pressure decreases after the initial perforation to a value below the fracture propagation pressure, then increases above the fracture propagation pressure upon injection of the fracturing fluid.

SUMMARY OF THE INVENTION

The present invention relates generally to subterranean treatment operations, and more particularly to methods of fracturing sensitive subterranean formations.

An example of a method of the present invention is a method of completing a well in a subterranean formation, comprising: providing a hydrajetting tool disposed within a well bore in the formation; injecting a fluid through the hydrajetting tool into a first region of the formation at a velocity sufficient to form one or more perforation tunnels in the first region; maintaining the flow of fluid into the one or more perforation tunnels in the first region at a pressure greater than the fracture closure pressure, so as to create one or more fractures in the first region; plugging at least partially the one or more fractures in the first region with an isolation fluid; injecting a fluid through the hydrajetting tool into a second region of the formation at a velocity sufficient to form one or more perforation tunnels in the second region; and maintaining the flow of fluid into the one or more perforation tunnels in the second region at a pressure greater than the fracture closure pressure, so as to create one or more fractures in the second region.

Another example of a method of the present invention is a method of completing a well in a subterranean formation, comprising: providing a hydrajetting tool disposed within a well bore in the formation; perforating a first region in the formation by injecting a pressurized fluid through the hydrajetting tool into the formation, so as to form one or more perforation tunnels in the first region; initiating one or more fractures in the first region by injecting a fracturing fluid into the one or more perforation tunnels in the first region through the hydrajetting tool; pumping additional fracturing fluid into the one or more fractures in the first region through an annulus between an outer surface of the hydrajetting tool and the walls of the well bore, so as to propagate the one or more fractures in the first region, wherein the additional fracturing fluid is pumped through the annulus as soon as the one or more fractures are initiated; moving the hydrajetting tool up hole simultaneously with pumping additional fracturing fluid into the one or more fractures in the first region; perforating a second region in the subterranean formation by injecting a pressurized fluid through the hydrajetting tool into the formation, so as to form one or more perforation tunnels in the second region; initiating one or more fractures in the second region by injecting a fracturing fluid into the one or more perforation tunnels in the second region through the hydrajetting tool; pumping additional fracturing fluid into the one or more fractures in the second region through an annulus between an outer surface of the hydrajetting tool and the walls of the well bore, so as to propagate the one or more fractures in the second region, wherein the additional fracturing fluid is pumped through the annulus as soon as the one or more fractures are initiated; and moving the hydrajetting tool up hole simultaneously with pumping additional fracturing fluid into the one or more fractures in the second region.

Another example of a method of the present invention is a method of completing a well in a subterranean formation, comprising: providing a hydrajetting tool disposed within a well bore in the formation; perforating a first region of the formation by injecting a perforating fluid through a hydrajetting tool into the formation, so as to form one or more perforation tunnels in the first region; initiating one or more fractures in the one or more perforation tunnels in the first region by pumping a fracturing fluid through the hydrajetting tool; injecting additional fracturing fluid into the one or more fractures in the first region through both the hydrajetting tool and an annulus between an outer surface of the hydrajetting tool and the walls of the well bore, so as to propagate the one or more fractures in the first region, wherein the additional fracturing fluid is injected through the annulus as soon as the one or more fractures are initiated; perforating a second region of the formation by injecting the perforation fluid through the hydrajetting tool into the formation, so as to form one or more perforation tunnels in the second region; fracturing the second region by injecting the fracturing fluid into the one or more perforation tunnels in the second region; and pumping a sufficient quantity of fracturing fluid into the well bore while fracturing the second region to plug the fractures in the first region.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

Figure 1A:
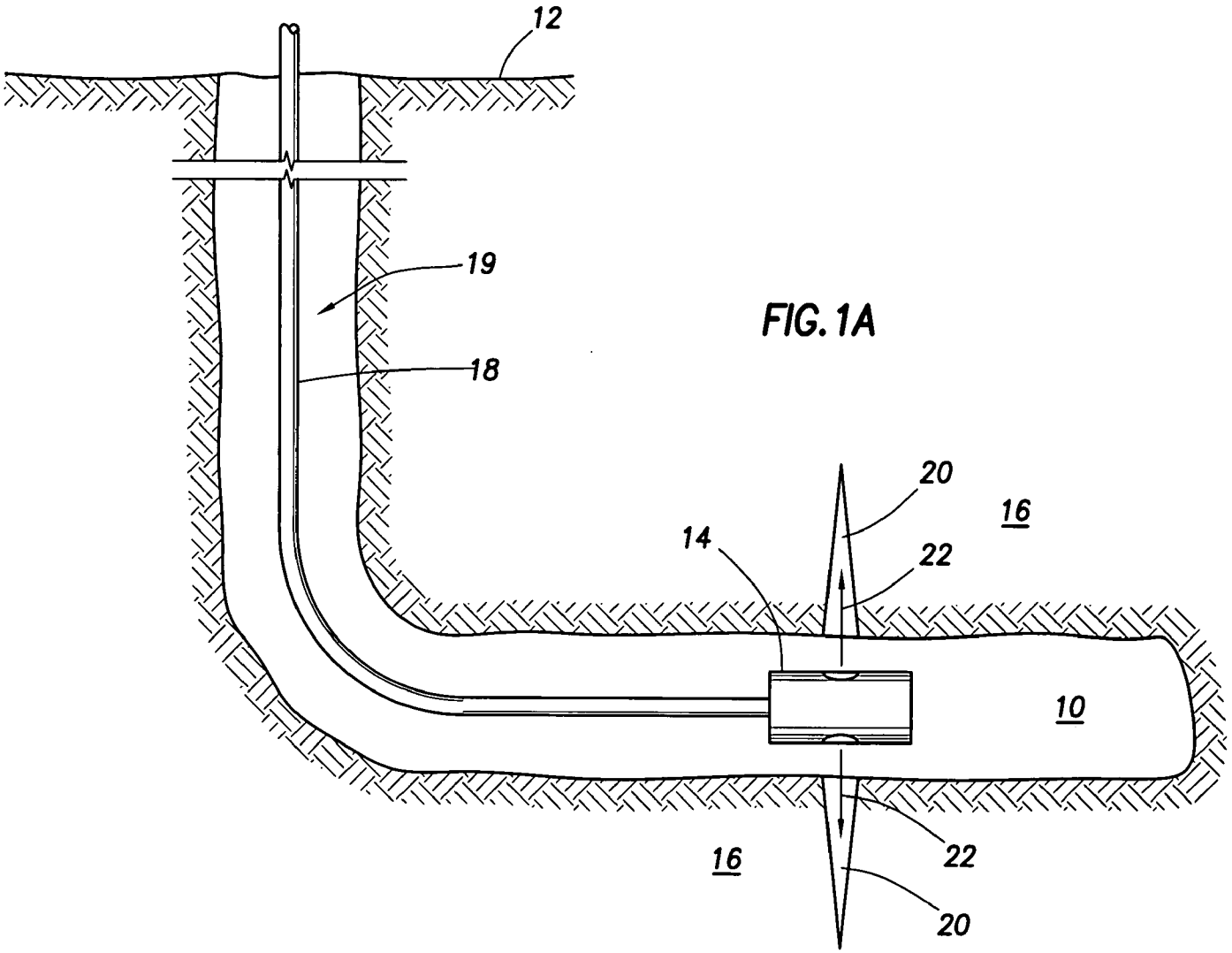
FIG. 1A is a schematic diagram illustrating a hydrajetting tool creating perforation tunnels through an uncased horizontal well bore in a first zone of a subterranean formation.

While the present invention is susceptible to various modifications and alternative forms, specific exemplary embodiments thereof have been shown in the drawings and are herein described. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The present invention relates generally to subterranean treatment operations, and more particularly to methods of fracturing sensitive subterranean formations.

Figure 1B:
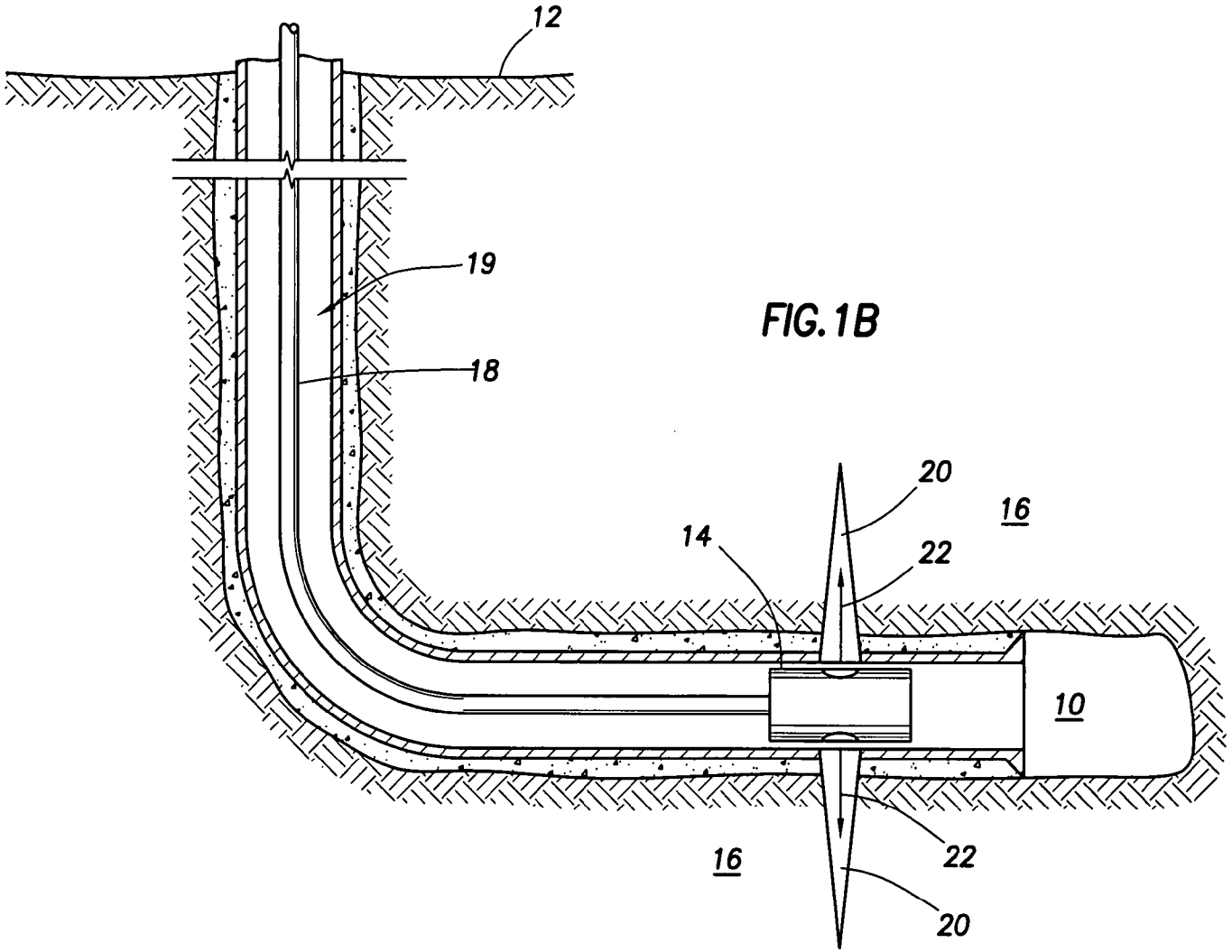
FIG. 1B is a schematic diagram illustrating a hydrajetting tool creating perforation tunnels through a cased horizontal well bore in a first zone of a subterranean formation.

Referring to FIGS. 1A and 1B, well bore 10 may be drilled into subterranean formation 12 using conventional (or future) drilling techniques. Next, depending upon the nature of formation 12, well bore 10 either may be left as an uncased open hole, as shown in FIG. 1A, or may be lined (e.g., with a casing string, slotted liner, or the like) as shown in FIG. 1B. Well bore 10 may be left as an uncased open hole if, for example, subterranean formation 12 is highly consolidated or in the case where the well is a highly deviated or horizontal well, which often may be difficult to line with casing. In cases where well bore 10 is lined with a casing string, the casing string may or may not be cemented to the formation 12. The casing in FIG. 1B is shown cemented to subterranean formation 12. Furthermore, when uncemented, the casing liner may be either a slotted or pre-perforated liner or a solid liner. Those of ordinary skill in the art, with the benefit of this disclosure, will recognize when well bore 10 should or should not be cased, whether such casing should or should not be cemented, and whether the casing string should be slotted, pre-perforated or solid.

Though FIGS. 2 through 10 illustrate the performance of certain embodiments of the methods of the present invention in an uncased well bore, those of ordinary skill in the art will recognize that each of the illustrated and described steps can be carried out in a cased or lined well bore. The methods of the present invention also may be applied to older well bores having portions that may benefit from stimulation.

Figure 2:
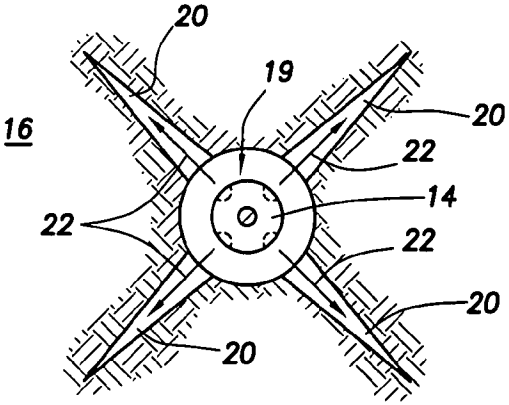
FIG. 2 is a schematic diagram illustrating a cross-sectional view of the hydrajetting tool shown in FIG. 1 forming four equally spaced perforation tunnels in the first zone of the subterranean formation.

Once well bore 10 has been drilled, and if deemed necessary cased, hydrajetting tool 14 may be placed into well bore 10 at a location of interest, e.g., adjacent to a first region 16 in subterranean formation 12. An example of a suitable hydrajetting tool 14 is described in U.S. Pat. No. 5,765,642, the relevant disclosure of which is hereby incorporated by reference. In one exemplary embodiment of the present invention, hydrajetting tool 14 may be attached to coiled tubing 18, which may lower hydrajetting tool 14 into well bore 10 and may supply hydrajetting tool 14 with jetting fluid. Annulus 19 is formed between coiled tubing 18 and well bore 10. Hydrajetting tool 14 then may operate to form perforation tunnels 20 in first region 16, as shown in FIG. 1. A perforation fluid may be pumped through hydrajetting tool 14, and returns may be taken through annulus 19. The perforation fluid being pumped through hydrajetting tool 14 generally contains a base fluid, which is commonly water and abrasives (e.g., sand). As shown in FIG. 2, four equally spaced jets (in this example) of fluid 22 may be injected into first region 16 of subterranean formation 12. As will be recognized by those of ordinary skill in the art, with the benefit of this disclosure, hydrajetting tool 14 may have any number of jets, configured in a variety of combinations along and around hydrajetting tool 14.

Figure 3:
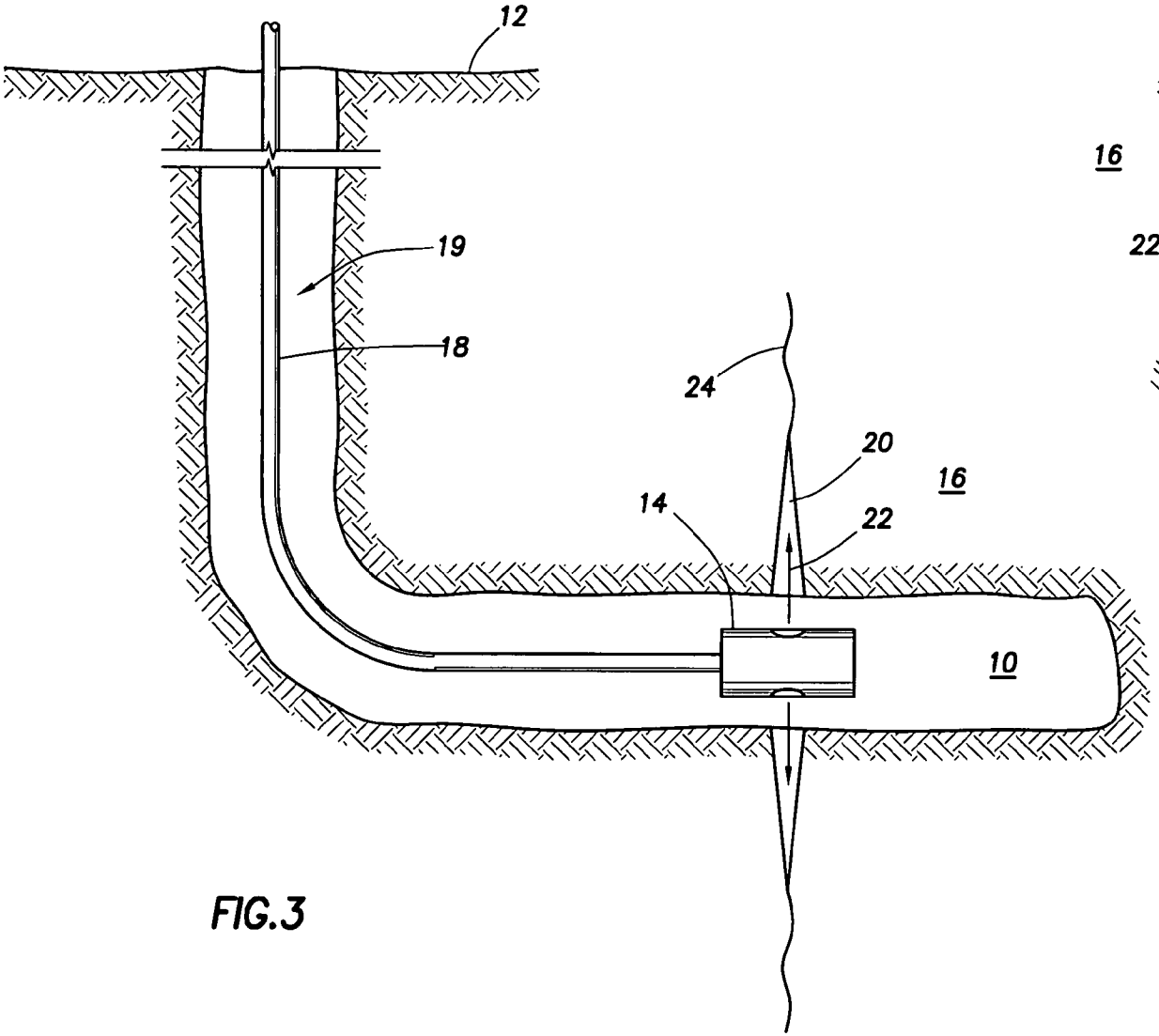
FIG. 3 is a schematic diagram illustrating the creation of fractures in the first zone by the hydrajetting tool wherein the plane of the fracture(s) is perpendicular to the well bore axis.

Once perforation tunnels 20 have been formed in first region 16, annulus 19 may be closed by any suitable means (e.g., by closing a valve (not shown) through which returns taken through annulus 19 have been discharged at the surface). Closure of annulus 19 may increase the pressure in well bore 10, and in formation 12, and thereby assist in creating, and extending, one or more dominant fractures in first region 16 adjacent hydrajetting tool 14. Closure of annulus 19 after the formation of perforation tunnels 20, and continuation of flow exiting hydrajet nozzles 46 (shown in FIGS. 11 A-B), also may ensure that the well bore pressure will not fall below the fracture closure pressure (e.g., the pressure necessary to maintain the one or more dominant fractures within formation 12 in an open position). Using this technique, the jetted fluid may form cracks or fractures 24 along perforation tunnels 20, as shown in FIG. 3. Generally, upon the initiation of the fracture, the well bore pressure will decrease briefly (which may signify that a fissure has formed in formation 12), but will not fall below the fracture propagation pressure. Further propagation of the one or more dominant fractures may be achieved by pumping fluid through hydrajetting tool 14, and by further increasing the flow of fluid into the one or more dominant fractures, inter alia, by flowing fluid into annulus 19, which may further enhance propagation of the fractures. Among other things, flowing fluid through both annulus 19 and through hydrajetting tool 14 may provide the largest possible flow path for the fluid, thereby increasing the rate at which the fluid may be forced into formation 12. Among other things, flowing fluid through both annulus 19 and through hydrajetting tool 14 may reduce erosion of the jets disposed along hydrajetting tool 14, particularly when the fluid is proppant-laden.

In certain embodiments of the present invention, an acidizing fluid may be injected into formation 12 through hydrajetting tool 14 after perforation tunnels 20 have been created, and shortly before (or during) the initiation of cracks or fractures 24. The acidizing fluid may etch formation 12 along cracks or fractures 24, thereby widening them. In certain embodiments, the acidizing fluid may dissolve fines, which further may facilitate flow into cracks or fractures 24.

In another embodiment of the present invention, a proppant may be included in the fluid being flowed into cracks or fractures 24, which proppant may prevent subsequent closure of cracks or fractures 24.

Once first region 16 has been fractured, the present invention provides for isolating first region 16, so that subsequent well operations, such as the fracturing of additional zones, can be carried out without the loss of significant amounts of fluid. This isolation step can be carried out in a number of ways. In certain embodiments of the present invention, first region 16 may be isolated by injecting into well bore 10 an isolation fluid 28 (sometimes referred to in the art as a diverting agent), which may have a higher viscosity than the fluids already in cracks or fractures 24 or well bore 10.

Figure 4A:
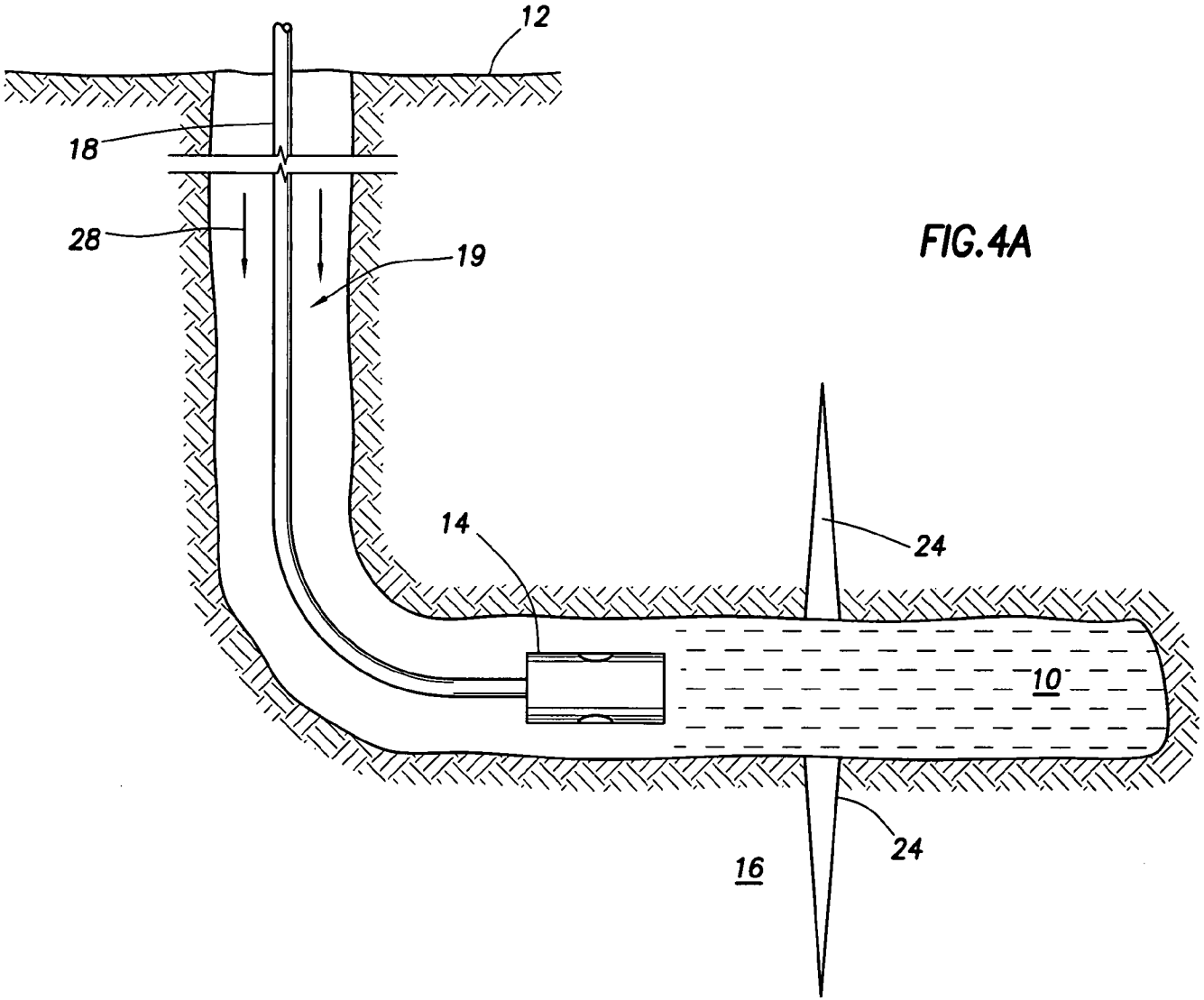
FIG. 4A is a schematic diagram illustrating one embodiment according to the present invention wherein the fractures in the first zone are plugged or partially sealed with an isolation fluid delivered through the well bore annulus after the hydrajetting tool has moved up hole.
Figure 4B:
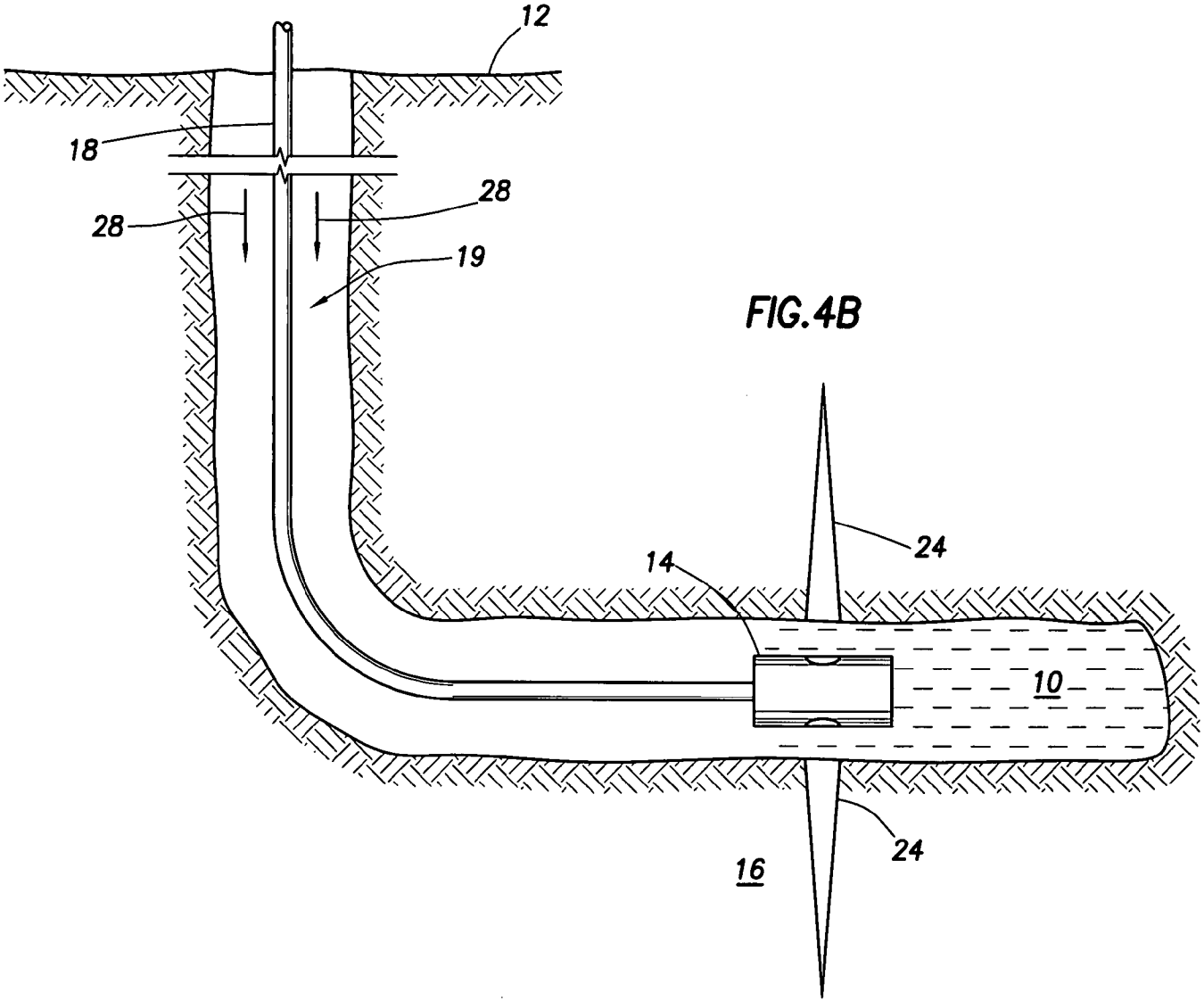
FIG. 4B is a schematic diagram illustrating another embodiment according to the present invention wherein the fractures in the first zone are plugged or partially sealed with an isolation fluid delivered through the well bore annulus before the hydrajetting tool has moved up hole.

In one embodiment of the present invention, isolation fluid 28 may be injected into well bore 10 by pumping it from the surface down annulus 19. More specifically, isolation fluid 28, which generally may be highly viscous, is squeezed out into annulus 19 and then washed downhole using a fluid having a lower viscosity than isolation fluid 28. In one implementation of this embodiment, isolation fluid 28 is not pumped into well bore 10 until after hydrajetting tool 14 has moved up hole, as shown in FIG. 4A. In another implementation of this embodiment, isolation fluid 28 may be pumped into well bore 10 (possibly at a reduced injection rate relative to the fluid flowrate used during the fracturing operation), before hydrajetting tool 14 has moved up hole, as shown in FIG. 4B. In certain embodiments of the present invention wherein the isolation fluid may be particularly highly viscous or may contain a significant concentration of solids, hydrajetting tool 14 may be moved out of the portion of formation 12 being plugged or partially sealed before isolation fluid 28 is pumped downhole, which may reduce the possibility that isolation fluid 28 may impede the movement of hydrajetting tool 14 within well bore 10.

Figure 4C:
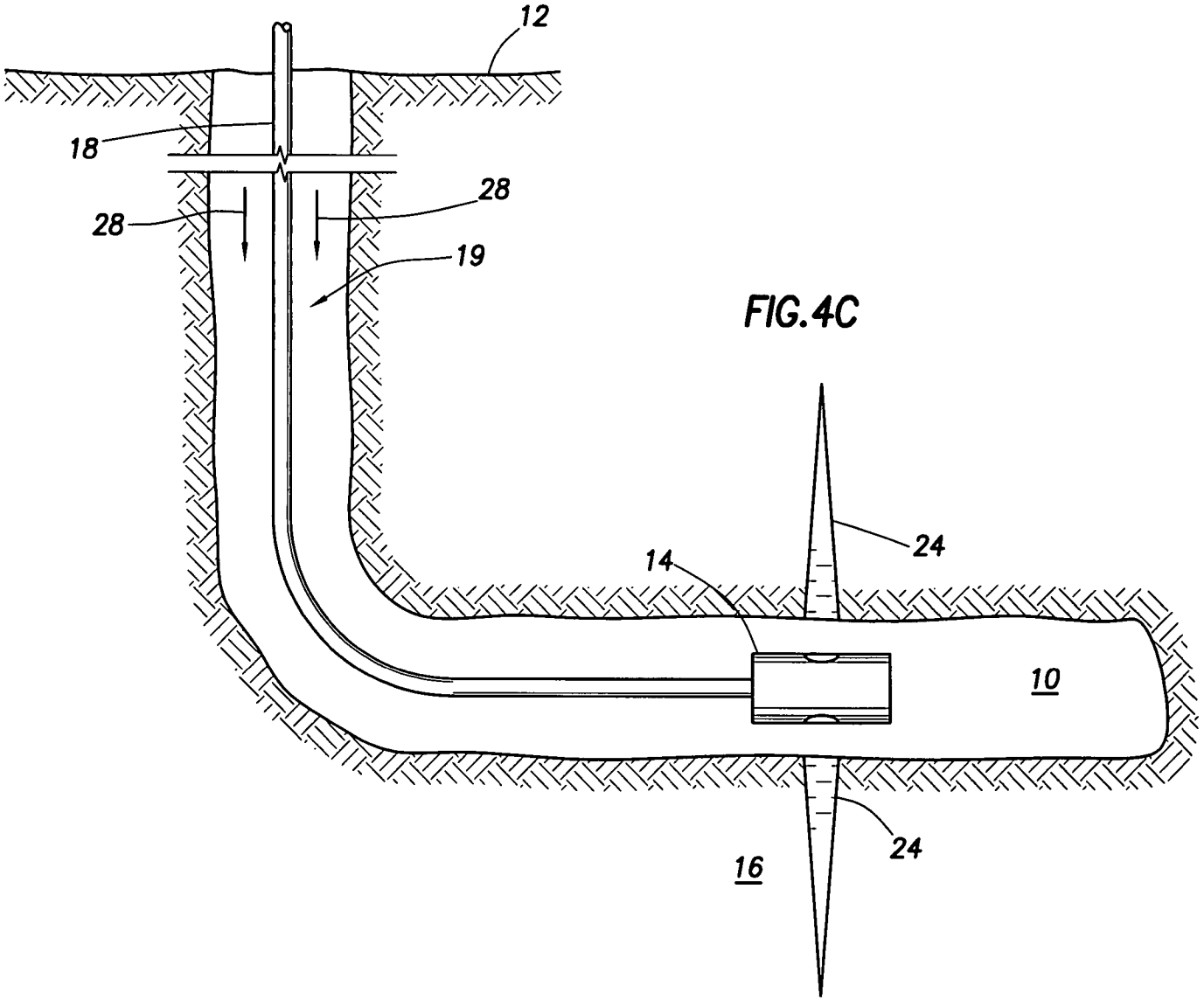
FIG. 4C is a schematic diagram illustrating another embodiment according to the present invention wherein the isolation fluid plugs the inside of the fractures rather than the well bore alone.
Figure 4D:
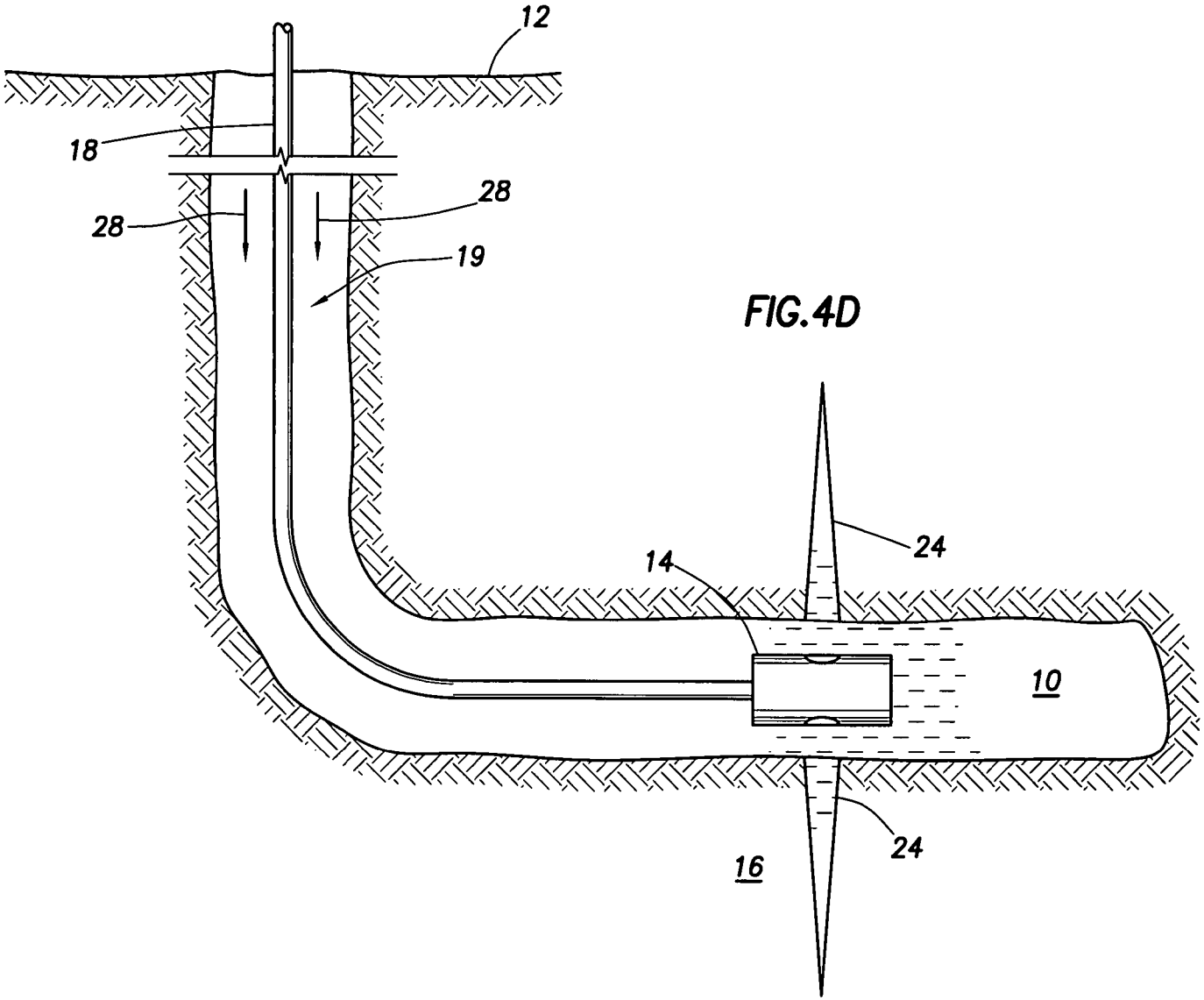
FIG. 4D is a schematic diagram illustrating another embodiment according to the present invention wherein the isolation fluid plugs the inside of the fractures and at least part of the well bore.

In the embodiments shown in FIGS. 4A and 4B, isolation fluid 28 is shown in well bore 10 alone. Alternatively, isolation fluid 28 could be pumped into the jetted perforations and/or the opening of cracks or fractures 24, as shown in FIG. 4C. In still another embodiment of the present invention, isolation fluid 28 may be pumped both in the opening of cracks or fractures 24 and partially in well bore 10, as shown in FIG. 4D. Among other things, pumping isolation fluid 28 into cracks or fractures 24 may restrict or impair further fluid flow into the cracks or fractures 24, while pumping or permitting isolation fluid 28 to remain in well bore 10 may restrict or impair further fluid flow into the jetted perforations.

Figure 5:
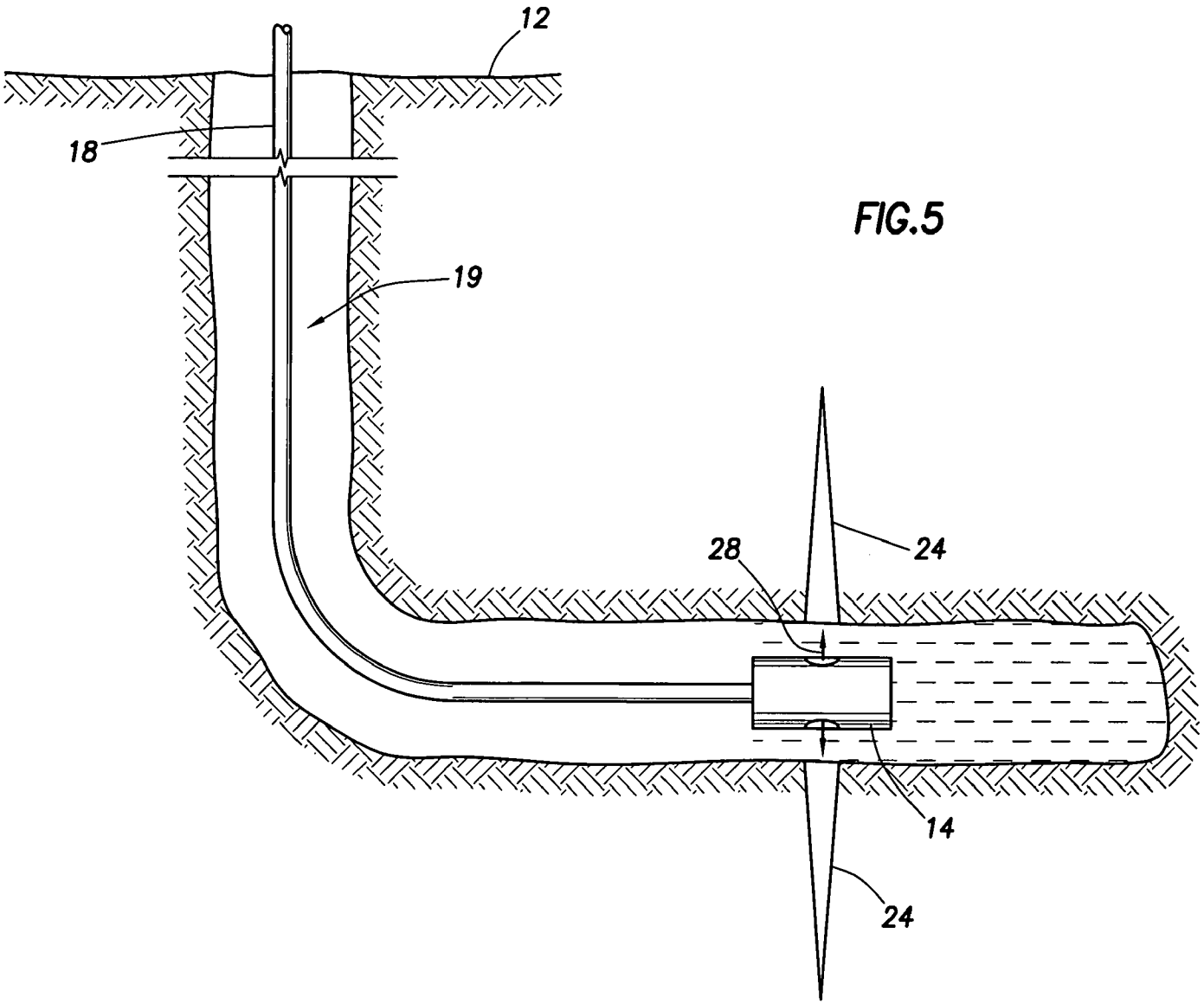
FIG. 5 is a schematic diagram illustrating another embodiment according to the present invention wherein the isolation fluid is delivered into the well bore through the hydrajetting tool.
Figure 6:
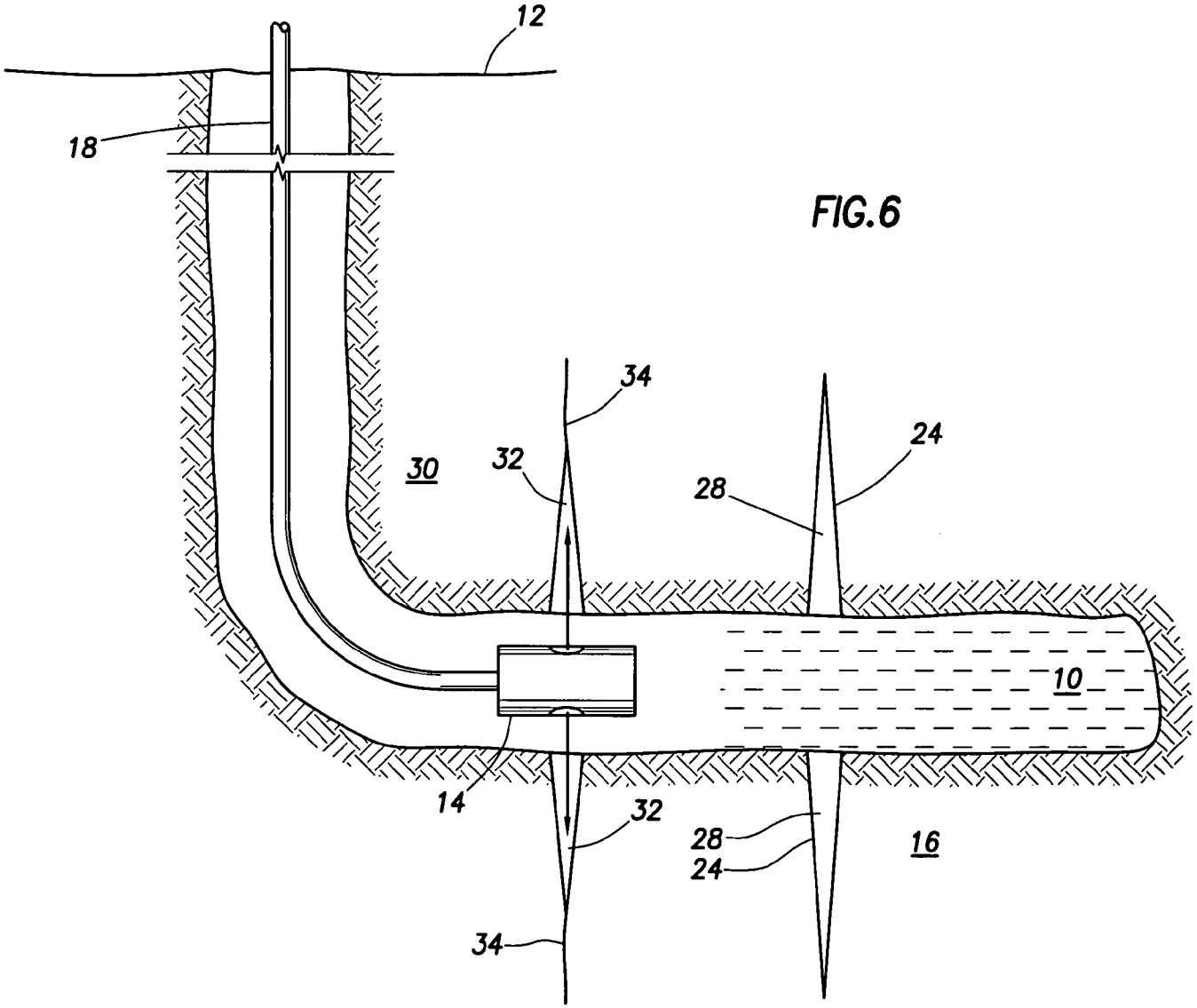
FIG. 6 is a schematic diagram illustrating the creation of fractures in a second zone of the subterranean formation by the hydrajetting tool after the first zone has been plugged.

In another embodiment of the present invention, isolation fluid 28 may be injected into well bore 10 adjacent first region 16 through jets 22 of hydrajetting tool 14, as shown in FIG. 5. In this embodiment of the present invention, the chemistry of isolation fluid 28 generally may be selected such that isolation fluid 28 does not substantially set up or solidify until after it has been injected into well bore 10.

In another embodiment of the present invention, isolation fluid 28 may be formed of a fluid having a similar chemical makeup as the fracturing fluid within well bore 10 during the fracturing operation. Isolation fluid 28 may have a greater viscosity than such fracturing fluid, however. In one embodiment of the present invention, isolation fluid 28 may be formed by mixing the fracturing fluid with a solid material. The solid material may include, inter alia, natural and man-made proppant agents (e.g., silica, ceramics, and bauxites), or any such material that has an external coating of any type. Alternatively, the solid (or semi-solid) material may include one or more paraffins, encapsulated acids or other chemicals, or resin beads. In certain embodiments wherein isolation fluid 28 comprises a fracturing fluid and a proppant, the concentration of proppant may be increased towards the end of the fracturing operation, to enhance isolation of the formation 12.

In another embodiment of the present invention, isolation fluid 28 may be formed of a highly viscous material, such as a gel or cross-linked gel. Examples of gels that may be used as the isolation fluid include, but are not limited to, fluids with high concentration of gels such as xanthan. Examples of crosslinked gels that may be used as isolation fluid 28 include, but are not limited to, high concentration gels (e.g., fluids that are commercially available from Halliburton Energy Services, Inc., under the trade names DELTA FRAC fluids or K-MAX fluids). "Heavy crosslinked gels" also may be used by mixing the crosslinked gels with delayed chemical breakers, encapsulated chemical breakers (which may reduce the viscosity of isolation fluid after a delay period), or with a material such as poly(lactic acid) beads. Though poly(lactic acid) beads initially may be a solid material, they may decompose into lactic acid over time, which may liquefy the crosslinked gels.

After isolation fluid 28 has been delivered into well bore 10 adjacent fractures 24, second region 30 in subterranean formation 12 may be fractured. If hydrajetting tool 14 has not already been moved within well bore 10 adjacent to second region 30, as in the embodiment of FIG. 4A, then it may be moved there after first region 16 has been plugged or partially sealed by isolation fluid 28. Once adjacent to second region 30, as in the embodiment illustrated in FIG. 6, hydrajetting tool 14 may operate to perforate the subterranean formation in second region 30, thereby forming perforation tunnels 32. Once perforation tunnels 32 have been formed in second region 30, subterranean formation 12 may be fractured to form fractures 34 in the manner described above. Annulus 19 may be closed by any suitable means, and further propagation of fractures 34 may be achieved by continuing to pump fluid (e.g., a fracturing fluid comprising a base fluid and, optionally, one or more additives, which may include proppant) through both hydrajetting tool 14 and annulus 19, such that the pressure in the well bore does not fall below the fracture closure pressure after the creation of perforation tunnels 32. After fractures 34 have been created and extended to a desired extent, fractures 34 then may be plugged or partially sealed by isolation fluid 28 using the same techniques discussed above with respect to fractures 24. The method may be repeated where it is desired to fracture additional zones within subterranean formation 12.

Figure 7:
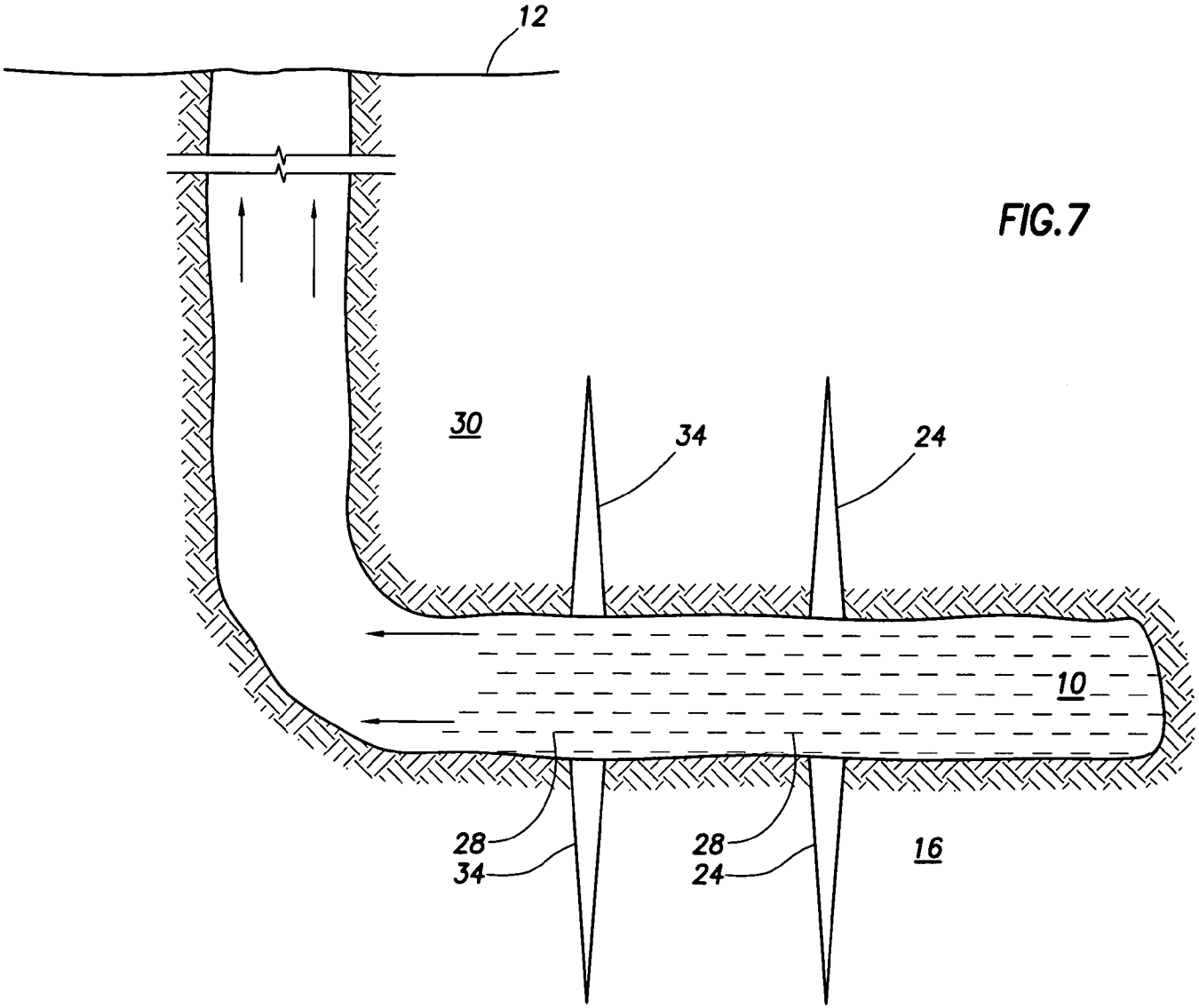
FIG. 7 is a schematic diagram illustrating one exemplary method of removing the isolation fluid from the well bore in the subterranean formation by allowing the isolation fluid to flow out of the well with production.
Figure 8A:
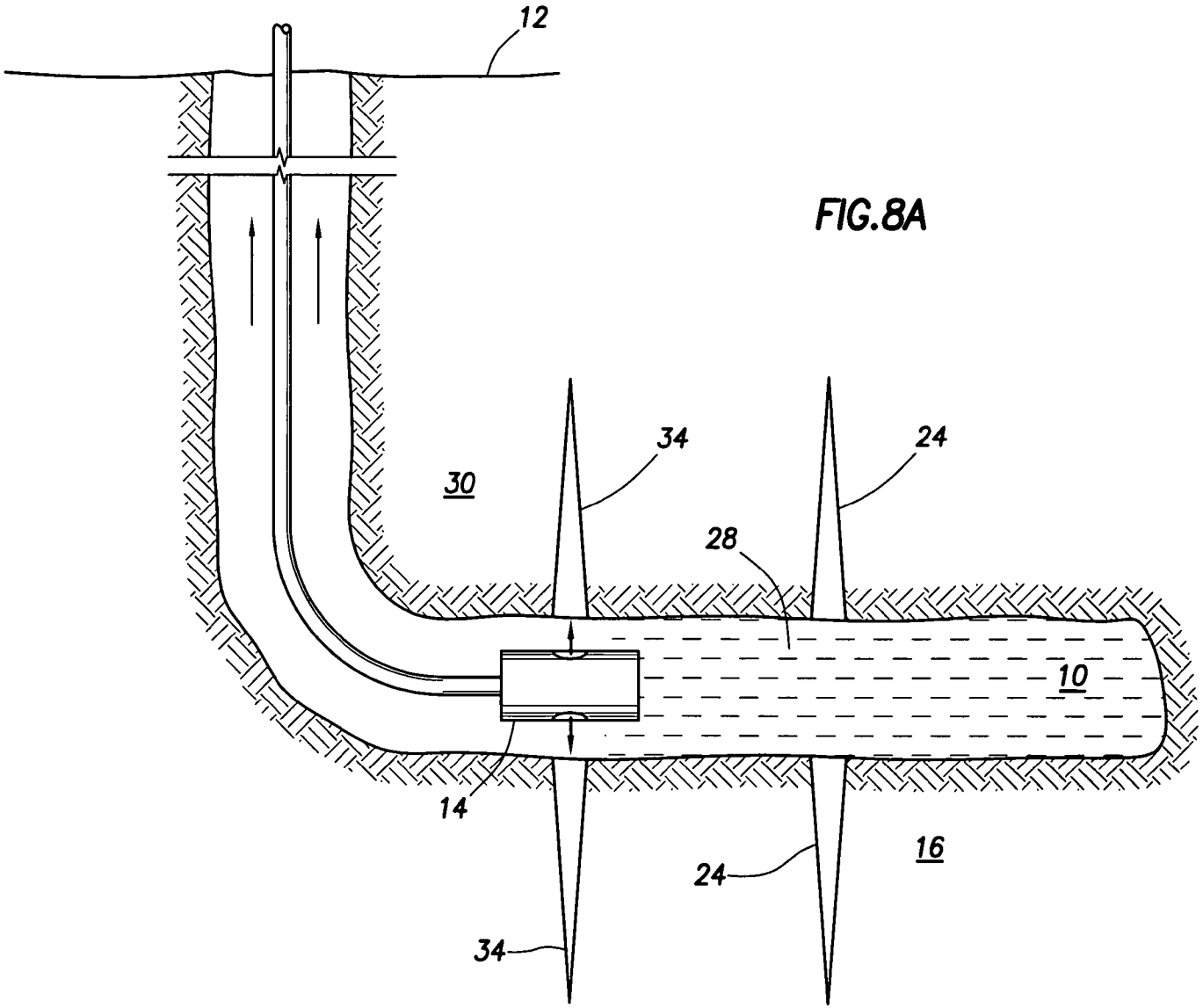
FIGS. 8A and 8B are schematic diagrams illustrating two other exemplary methods of removing the isolation fluid from the fractures in the subterranean formation.
Figure 8B:
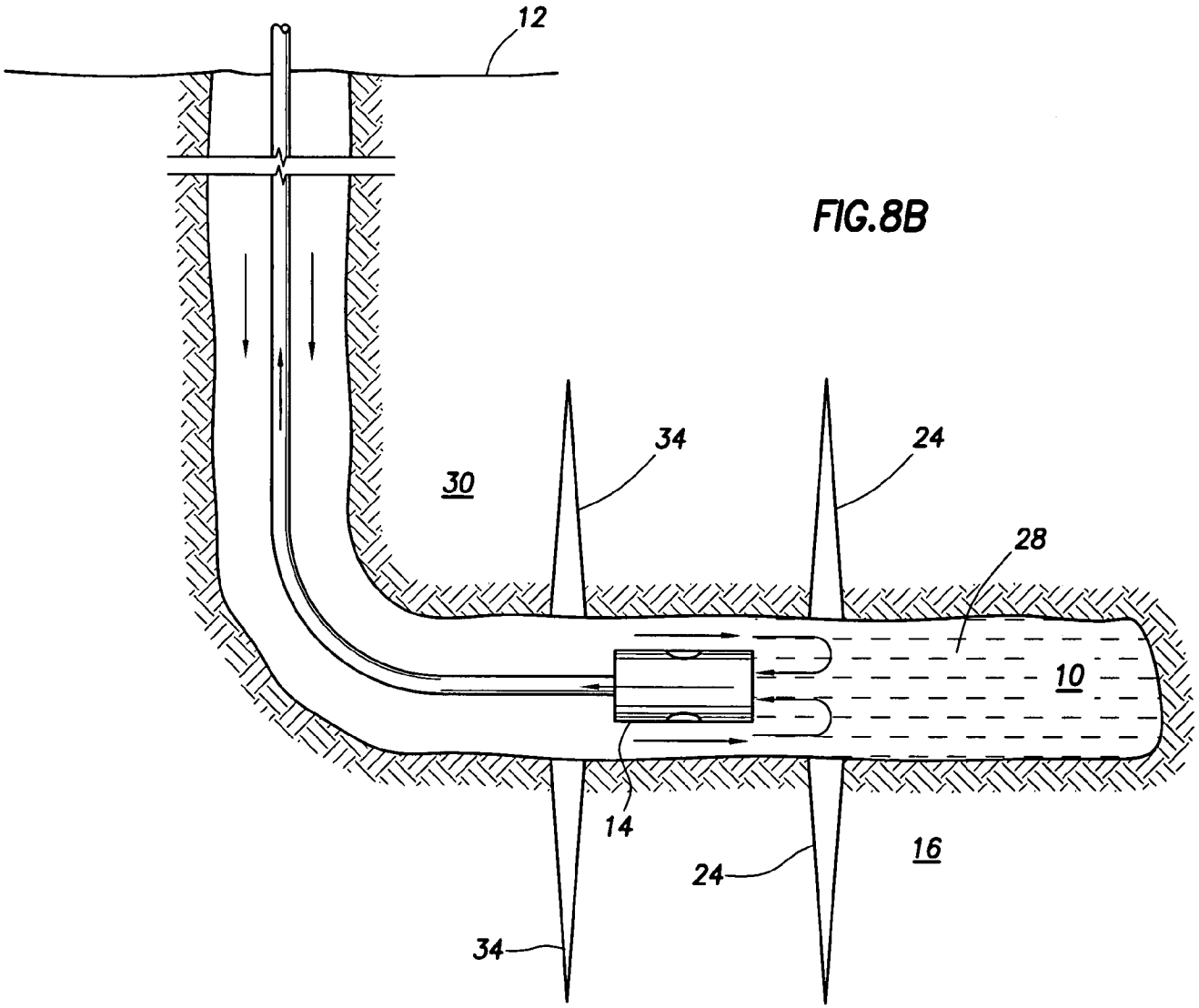

Once all of the desired zones have been fractured, isolation fluid 28 may be recovered, thereby unplugging fractures 24 and 34 for subsequent use in the recovery and production of hydrocarbons from subterranean formation 12. For example, the production of hydrocarbons from the well may displace isolation fluid 28, as shown in FIG. 7. In certain embodiments of the present invention, isolation fluid 28 may consist of chemicals that may break or reduce the viscosity of isolation fluid 28 over time, to facilitate displacement of isolation fluid 28 from fractures 24 and 34 at a desired time. Another method of recovering isolation fluid 28 may involve washing or reversing out isolation fluid 28 by circulating a fluid, gas or foam into well bore 10, as shown in FIG. 8A. Another alternate method of recovering isolation fluid 28 may involve hydrajetting out isolation fluid 28 using hydrajetting tool 14, as shown in FIG. 8B. These latter methods may be particularly well suited in certain embodiments of the present invention wherein isolation fluid 28 may contain solids and well bore 12 may be highly deviated or horizontal.

Figure 9A:
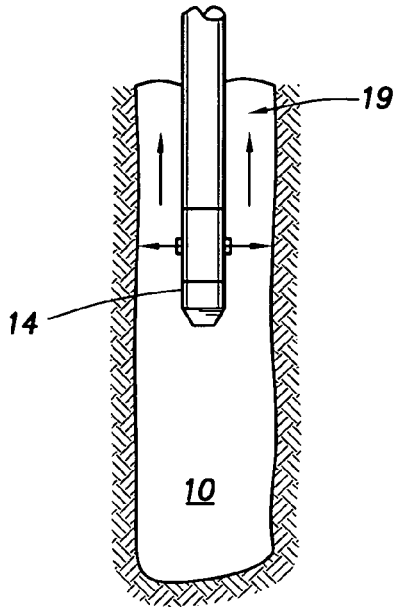
FIGS. 9A-9D illustrate another exemplary method of fracturing multiple zones in a subterranean formation and plugging or partially sealing those zones in accordance with the present invention.

The following is another method of completing a well in a subterranean formation in accordance with the present invention. First, well bore 10 may be drilled in subterranean formation 12. Next, first region 16 in subterranean formation 12 may be perforated by injecting a pressurized fluid through hydrajetting tool 14 into formation 12, as illustrated in FIG. 9A, so as to form one or more perforation tunnels 20, as shown, for example, in FIG. 9B. In certain embodiments of the present invention, hydrajetting tool 14 may be kept stationary during perforation. Alternatively, however, hydrajetting tool 14 may be fully or partially rotated so as to cut slots into formation 12. Alternatively, hydrajetting tool 14 may be moved axially during perforation. Alternatively, hydrajetting tool 14 may be rotated and axially moved simultaneously within well bore 10 so as to form a straight or helical cut or slot. Next, one or more fractures 24 may be initiated in first region 16 of subterranean formation 12 by injecting a fracturing fluid into the one or more perforation tunnels 20 through hydrajetting tool 14, as shown, for example, in FIG. 3. The annulus may be closed in to raise the pressure and for the fracturing fluid into formation 12. Initiating the fracture with hydrajetting tool 14 and closing in the annulus may be advantageous over conventional techniques (e.g., wireline guns) because this technique may allow for a lower breakdown pressure on formation 12 and may prevent cycling the formation pressure, which more readily may initiate a single dominant fracture within formation 12. Furthermore, it may result in a more accurate and better quality perforation.

Figure 9C:
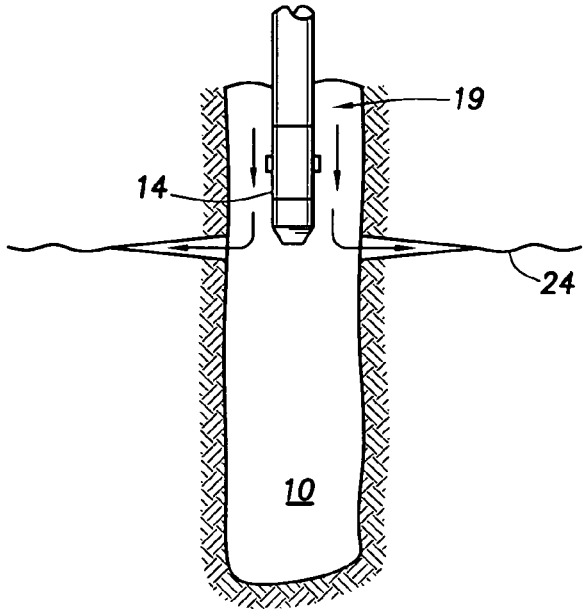
Figure 9B:
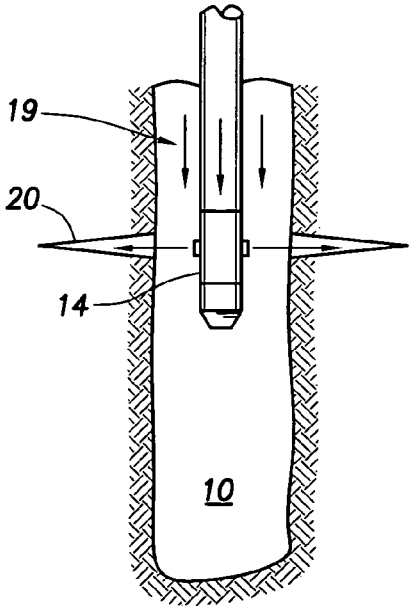
Figure 9D:
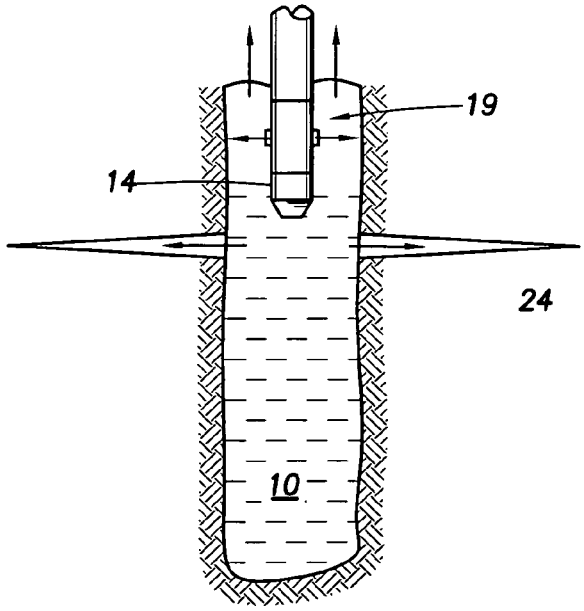

Fracturing fluid may be pumped down annulus 19 as soon as the one or more fractures 24 are initiated, so as to propagate fractures 24, as shown in FIG. 9B, for example. Any cuttings left in annulus 19 from the perforating step may be pumped into fractures 24 during this step.

After fractures 24 have been initiated, hydrajetting tool 14 may be moved up hole. In certain embodiments of the present invention, hydrajetting tool 14 may be moved up hole while the fracturing fluid is being pumped down through annulus 19 to propagate fractures 24, as shown in FIG. 9C. The rate of fluid being discharged through hydrajetting tool 14 may be decreased once fractures 24 have been initiated. The annulus injection rate may or may not be increased at this juncture in the process.

After fractures 24 have been propagated and hydrajetting tool 14 has been moved up hole, isolation fluid 28 may be pumped into well bore 10 adjacent to first region 16, in accordance with the present invention. Over time, isolation fluid 28 may plug the one or more fractures 24 in first region 16, as shown, for example, in FIG. 9D. (Although not shown, those of skill in the art, with the benefit of this disclosure, will appreciate that isolation fluid 28 may permeate into fractures 24.) The steps of perforating formation 12, initiating fractures 24, propagating fractures 24, and plugging or partially sealing fractures 24 may be repeated for as many additional regions as desired, although only second region 30 has been shown in FIGS. 6-10.

After all desired fractures have been formed in formation 12, isolation fluid 28 may be removed from subterranean formation 12. The removal of isolation fluid 28 may be accomplished in a number of ways, including, but not limited to, those that already have been mentioned (e.g., permitting hydrocarbons produced from the subterranean reservoir to displace isolation fluid 28 into well bore 10, reverse-circulating isolation fluid 28 from well bore 10, hydrajetting isolation fluid 28 out of well bore 10, and the like). In certain embodiments of the present invention, an acid may be pumped into well bore 10 so as to activate, de-activate, or dissolve isolation fluid 28 in situ. In certain other embodiments of the present invention, nitrogen may be pumped into well bore 10 to remove isolation fluid 28 therefrom, and also to remove other fluids and materials that may be left in well bore 10.

Yet another method in accordance with the present invention now will be described. First, as with the other methods, well bore 10 may be drilled. Next, first region 16 in subterranean formation 12 may be perforated by injecting a pressurized fluid through hydrajetting tool 14 into formation 12, so as to form one or more perforation tunnels 20. Hydrajetting tool 14 also may be rotated, or axially moved, or rotated and axially moved during this step to cut slots into formation 12. Next, one or more fractures 24 may be initiated in first region 16 of formation 12 by injecting a fracturing fluid into the one or more perforation tunnels 20 through hydrajetting tool 14 and by closing or restricting the flow of fracturing fluid returning to the surface via annulus 19 (e.g., by closing a discharge valve at or about the surface that, when open, permits fluid flow through the annulus towards the surface), so as to further force the fracturing fluid into formation 12. Contemporaneously with the closure or restriction of the return flow of fracturing fluid through annulus 19, additional fracturing fluid may be pumped from the surface into annulus 19, and may enter the one or more fractures 24 in first region 16 so as to propagate fractures 24. During this step, any cuttings present in annulus 19 after the drilling and perforation steps may be pumped into the one or more fractures 24. In certain embodiments, hydrajetting tool 14 may be moved up hole while fracturing fluid is pumped from the surface into annulus 19. Once the desired volume of fracturing fluid has been pumped, pumping of the fracturing fluid into formation 12 through annulus 19 may be discontinued. All of the aforementioned steps then may be repeated for second region 30 and any subsequent regions thereafter. The rate at which the fracturing fluid may be ejected from hydrajetting tool 14 may be decreased as hydrajetting tool 14 is moved up hole, and even may be halted altogether.

An additional method in accordance with the present invention now will be described. First, well bore 10 may be drilled. Next, first region 16 in subterranean formation 12 may be perforated by injecting a pressurized fluid through hydrajetting tool 14 into formation 12, so as to form one or more perforation tunnels 20. After initiation of injection of the pressurized fluid through hydrajetting tool 14, annulus 19 may be closed in to restrict return flow therethrough, which may enhance the rate at which the pressurized fluid is injected into formation 12 through hydrajetting tool 14. Optionally, hydrajetting tool 14 may be rotated so as to cut slots into subterranean formation 12. Alternatively, hydrajetting tool 14 can be rotated and/or moved axially within well bore 10, so as to create a straight or helical cut into formation 16. Next, one or more fractures 24 may be initiated in first region 16 by injecting a fracturing fluid into the one or more perforation tunnels or cuts 20 through hydrajetting tool 14, and simultaneously pumping additional fracturing fluid into the one or more fractures 24 in first region 16 through annulus 19 so as to propagate fractures 24. Any cuttings left in annulus 19 after the drilling and perforation steps are pumped into the fracture during this step. Simultaneous with this latter step, hydrajetting tool 14 is moved up hole and operated to perforate the next region. Pumping of the fracturing fluid down annulus 19 into fractures 24 then may be discontinued, at which time hydrajetting tool 14 may begin initiating fractures 34 in the second region, and fluid may be pumped down the annulus 19 to propagate fractures 34 in the second region. In certain alternative embodiments, fluid may be pumped continuously down annulus 19 during the time in which hydrajetting tool 14 begins initiating fractures 34 in the second region. The process then may be repeated.

Figure 10A:
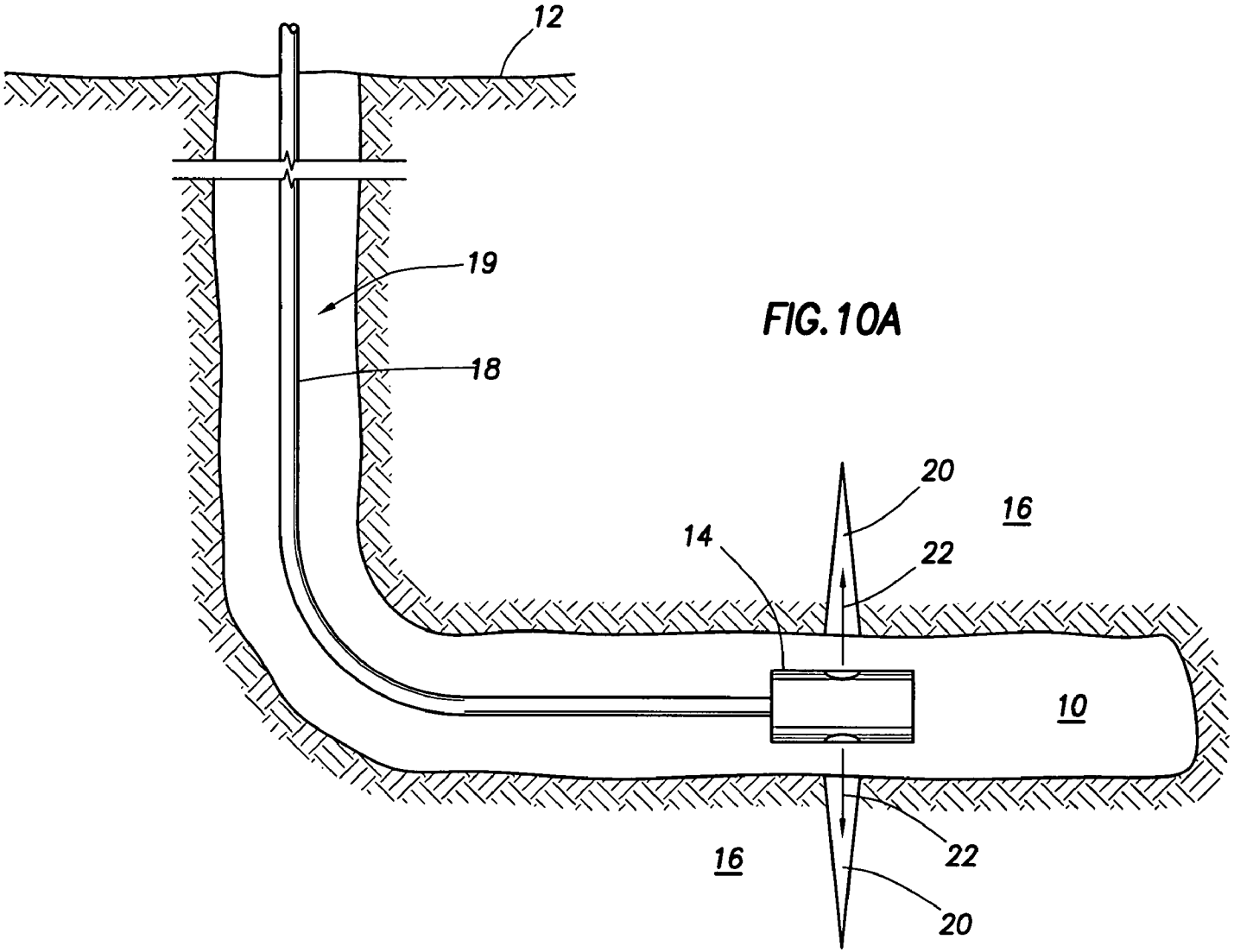
FIGS. 10A-10C illustrate yet another exemplary method of fracturing multiple zones in a subterranean formation and plugging or partially sealing those zones in accordance with the present invention.

Yet another method in accordance with the present invention now will be described with reference to FIGS. 10A-C. First, well bore 10 may be drilled. Next, first region 16 in subterranean formation 12 may be perforated by injecting a pressurized fluid through hydrajetting tool 14 into formation 12, so as to form one or more perforation tunnels 20, as shown in FIG. 10A. The pressurized fluid injected into formation 12 during this step may contain an abrasive to improve penetration into formation 12. Hydrajetting tool 14 may be rotated during this step to cut a slot or slots into subterranean formation 12. Alternatively, hydrajetting tool 14 may be rotated and/or moved axially within well bore 10, so as to create a straight or helical cut into formation 12. After initiation of injection of the pressurized fluid through hydrajetting tool 14, annulus 19 may be closed in to restrict return flow therethrough, which may enhance the rate at which the pressurized fluid is injected into formation 12 through hydrajetting tool 14.

Figure 10B:
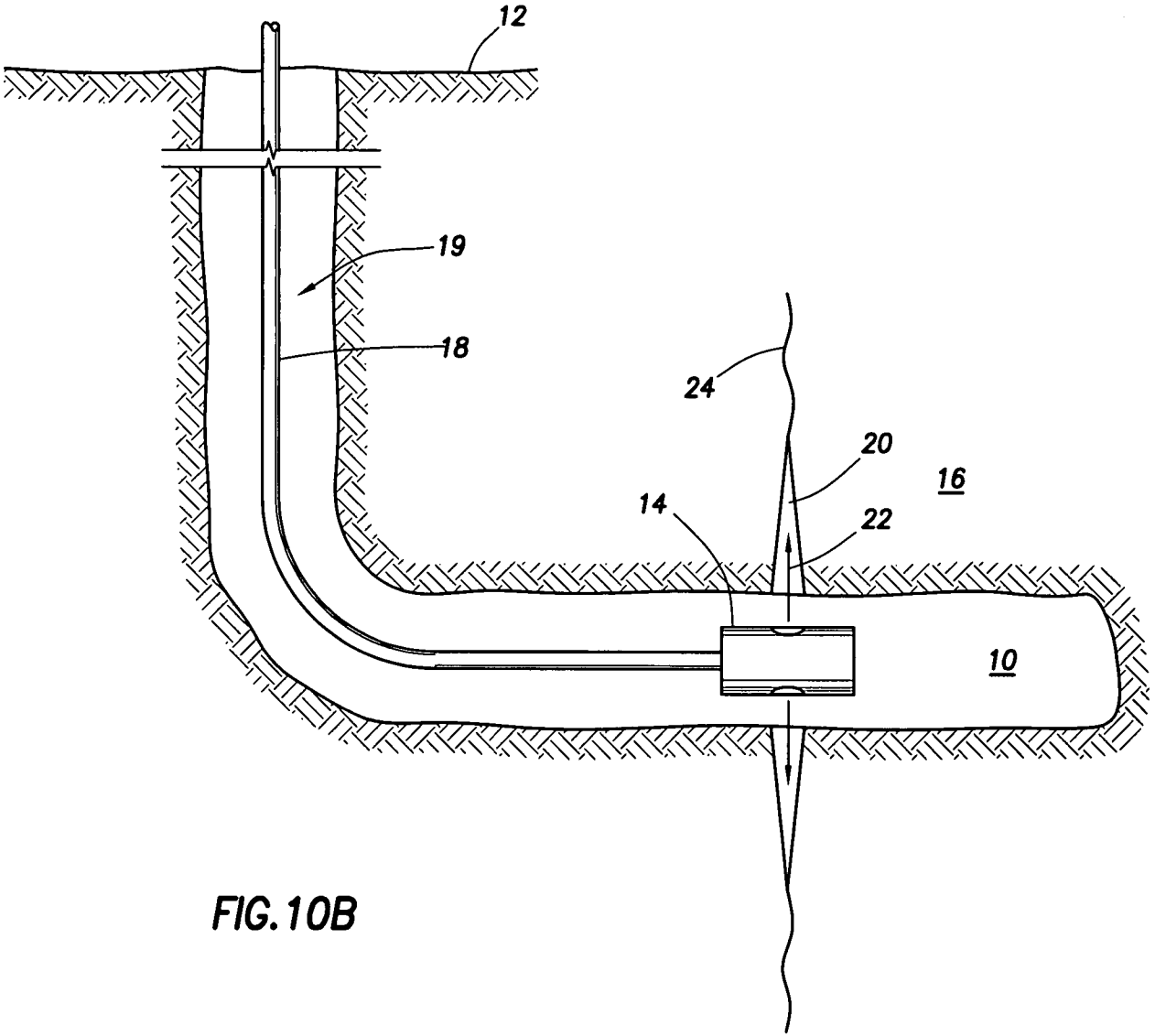
Figure 10C:
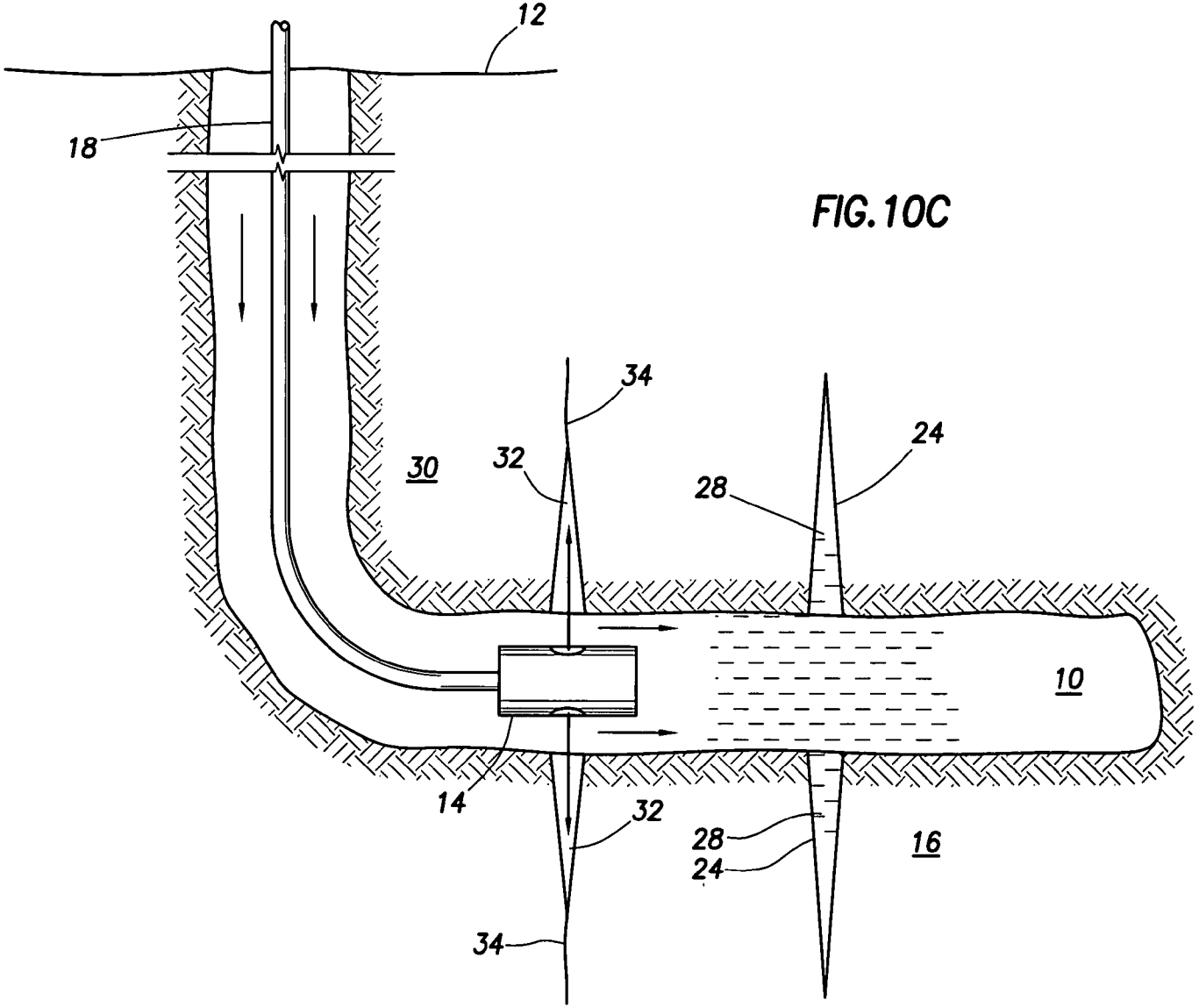

Next, one or more fractures 24 may be initiated in first region 16 by injecting a fracturing fluid into the one or more perforation tunnels or cuts 20 through hydrajetting tool 14, as shown in FIG. 10B, and also through annulus 19. The injection of the fracturing fluid occurs without cessation of the injection of the pressurized fluid through hydrajetting tool 14. During this step, the base fluid injected into first region 16 may contain a very small size particle, such as a 100 mesh silica sand (also known as "Oklahoma No. 1"). Next, a second fracturing fluid that may or may not have a second viscosity greater than that of the first fracturing fluid, may be injected into fractures 24 to thereby propagate fractures 24. The second fracturing fluid generally comprises the base fluid, sand, one or both of an adhesive and consolidation agent, and optionally a crosslinker. In certain embodiments of the present invention, the adhesive may be a conductivity enhancer that is commercially available from Halliburton Energy Services, Inc., under the trade name "SAND-WEDGE." In certain embodiments of the present invention, the consolidation agent may be one that is commercially available from Halliburton Energy Services, Inc., under the trade name "EXPEDITE." The second fracturing fluid may be delivered in one or more of the ways described herein. Also, an acidizing step may also be performed.

Next, hydrajetting tool 14 may be moved to second region 30, where it may be used to perforate that region, thereby forming perforation tunnels or cuts 32. Next, fractures 34 in second region 30 may be initiated using the above-described technique or a similar technique. Next, fractures 34 in second region 30 may be propagated by injecting into fractures 34 a second fluid similar to the fluid described above (e.g., the fluid containing the adhesive and/or consolidation agent). A sufficient quantity of fracturing fluid may be pumped downhole to fill well bore 10 and the openings of fractures 24 in first region 16. This occurs as follows. The relatively high temperature downhole may cause sand particles in the fracturing fluid to bond to one another in clusters, or as a loosely-packed bed, thereby forming an in situ plug. Initially, some of the fracturing fluid may flow into perforation tunnels 32 and possibly part way into fractures 24, and may leak out into formation 12 in first region 16, but generally the openings of fractures 24 will become plugged or partially sealed within a relatively short amount of time, as will be recognized by those of ordinary skill in the art, with the benefit of this disclosure. Once the openings of fractures 24 become filled, a sufficient quantity of fracturing fluid may be pumped down well bore 10 to fill some or all of well bore 10 adjacent fractures 24, as shown in FIG. 10C. Ultimately, a sufficient quantity of fracturing fluid and proppant may be pumped downhole to cause first region 16 to be plugged or partially sealed. This process then may be repeated for subsequent regions of formation 12 after subsequent perforating and fracturing stages up-hole.

Figure 11A:
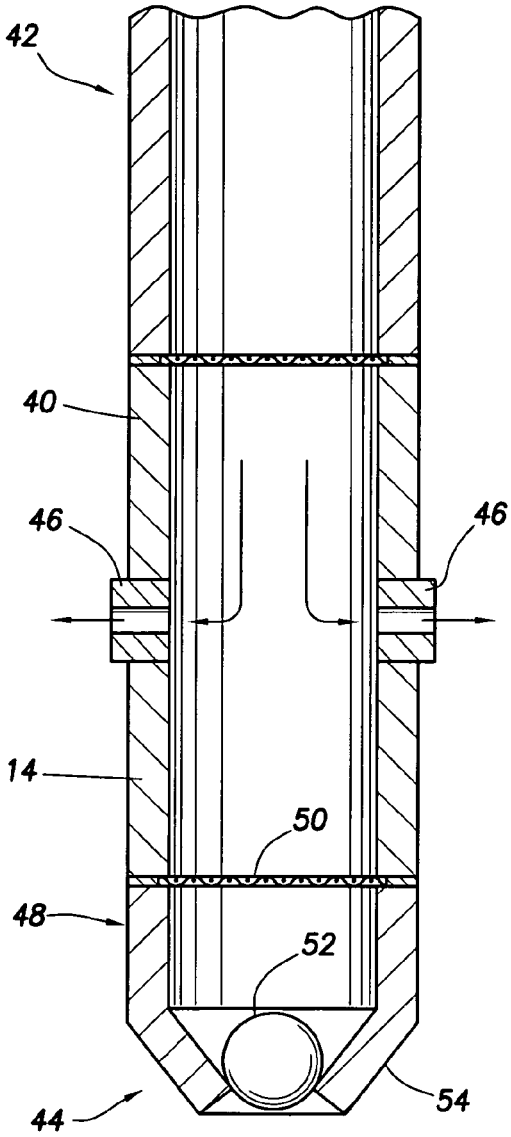
FIGS. 11A and 11B illustrate operation of a hydrajetting tool for use in carrying out the methods according to the present invention.
Figure 11B:
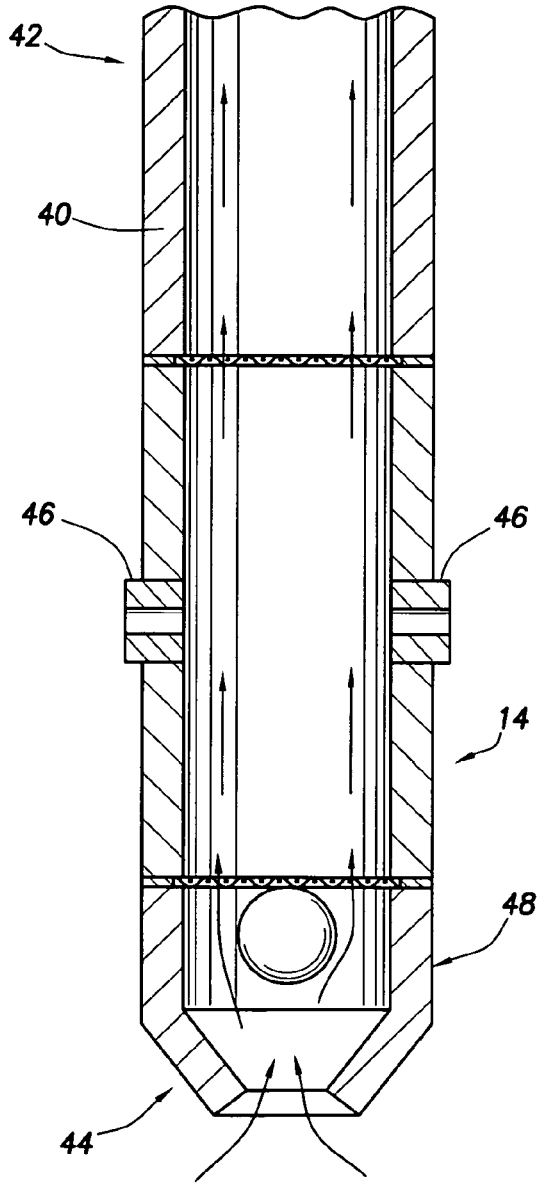

FIGS. 11A-B illustrate the details of hydrajetting tool 14 for use in carrying out the methods of the present invention. Hydrajetting tool 14 comprises main body 40, which is cylindrical in shape and formed of a ferrous metal. The main body 40 comprises top end 42 and bottom end 44. Top end 42 connects to coiled tubing 18 for operation within well bore 10. Main body 40 comprises a plurality of nozzles 46, which may be adapted to direct the high pressure fluid out of main body 40. In certain embodiments of the present invention, nozzles 46 may be disposed at an angle to main body 40, so as to eject the pressurized fluid out of main body 40 at an angle other than 90°.

Hydrajetting tool 14 further comprises fluid opening means 48 for opening hydrajetting tool 14 to fluid flow from well bore 10. Such fluid opening means 48 includes a fluid-permeable plate 50, which may be mounted to the inside surface of main body 40. The fluid-permeable plate 50 traps a ball 52, which may sit in seat 54 when the pressurized fluid is being ejected from nozzles 46, as shown in FIG. 11A. When the pressurized fluid is not being pumped down coiled tubing 18 into hydrajetting tool 14, the well bore fluid may be circulated up to the surface via fluid opening means 48. More specifically, the well bore fluid lifts ball 52 up against fluid-permeable plate 50, which in turn may allow the well bore fluid to flow up hydrajetting tool 14 and ultimately up through coiled tubing 18 to the surface, as shown in FIG. 11B. As will be recognized by those of ordinary skill in the art, with the benefit of this disclosure, other valves may be used in place of the ball and seat arrangement 52 and 54 shown in FIGS. 11A and 11B. Darts, poppets, and even flappers (such as a balcomp valve, and the like) may be used. Furthermore, although FIGS. 11A and 11B only show a valve at the bottom of hydrajetting tool 14, such valves can be placed both at the top and the bottom, as desired.

Yet another method in accordance with the present invention now will be described. First, first region 16 in subterranean formation 12 may be perforated by injecting a perforating fluid through hydrajetting tool 14 into formation 12, so as to form perforation tunnels 20, as shown, for example, in FIG. 1A. After initiation of injection of the perforating fluid through hydrajetting tool 14, annulus 19 may be closed in. Next, fractures 24 may be initiated in perforation tunnels 20 by pumping a fracturing fluid through hydrajetting tool 14, as shown, for example, in FIG. 3. The fracturing fluid is pumped through hydrajetting tool 14 without ceasing to pump the perforating fluid through hydrajetting tool 14. Annulus 19 remains closed. Fractures 24 then may be propagated by injecting additional fracturing fluid into fractures 24 through both hydrajetting tool 14 and annulus 19. Fractures 24 then may be plugged, at least partially, by pumping isolation fluid 28 into the openings of fractures 24 and/or a well bore section adjacent to fractures 24. Isolation fluid 28 may be pumped into this region either through annulus 19, as shown in FIG. 4, or through hydrajetting tool 14, as shown in FIG. 5, or a combination of both. Once fractures 24 have been plugged, hydrajetting tool 14 may be moved away from first region 16. Hydrajetting tool 14 may be moved up hole for subsequent fracturing, or hydrajetting tool 14 may be moved downhole, e.g., when spotting a fluid across perforations for sealing where it may be desired to pump the fluid from a point below the zone of interest to promote full coverage. Hydrajetting tool 14 then may be pulled up through the spotted fluid. Lastly, these steps (or a subset thereof) may be repeated for subsequent regions of subterranean formation 12.

As is well known in the art, a positioning device, such as a gamma ray detector or casing collar locator (not shown), may be included in the bottom hole assembly to improve the positioning accuracy of the perforations.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method of completing a well in a subterranean formation, comprising:

providing a hydrajetting tool disposed within a well bore in the subterranean formation;

injecting a fluid through the hydrajetting tool into a first region of the subterranean formation at a velocity sufficient to form one or more perforation tunnels in the first region;

moving the hydrajetting tool to a second region of the subterranean formation while flowing a fluid continuously through an annulus between an outer surface of the hydrajetting tool and a wall of the well bore into at least one of the one or more perforation tunnels in the first region at a pressure greater than the fracture closure pressure, so as to create one or more fractures in the first region;

flowing a fracturing fluid down the annulus to extend at least one of the one or more fractures in the first region;

plugging at least partially at least one of the one or more fractures in the first region with an isolation fluid while injecting a fluid through the hydrajetting tool into a second region of the formation at a velocity sufficient to form one or more perforation tunnels in the second region; and flowing a fluid continuously through the annulus into at least one of the one or more perforation tunnels in the second region at a pressure greater than the fracture closure pressure, so as to create one or more fractures in the second region.

2. The method of claim 1, further comprising moving the hydrajetting tool to the second region before plugging at least partially at least one of the one or more fractures in the first region with the isolation fluid.

3. The method of claim 1, further comprising moving the hydrajetting tool to the second region after plugging at least partially at least one of the one or more fractures in the first region with the isolation fluid.

4. The method of claim 1, wherein the isolation fluid comprises a solid or semi-solid material.

5. The method of claim 1, further comprising removing the isolation fluid from the first region.

6. The method of claim 5, wherein removing the isolation fluid from the first region comprises circulating the isolation fluid out of the well bore.

7. The method of claim 6, wherein removing the isolation fluid from the first region comprises hydrajetting the isolation fluid out of the well bore.

8. The method of claim 1, wherein flowing fluid continuously through the annulus into at least one of the one or more perforation tunnels in the first region at the pressure greater than the fracture closure pressure comprises injecting fluid into at least one of the one or more perforation tunnels in the first region through both the hydrajetting tool and through the annulus.

9. The method of claim 1 wherein:

injecting a fluid through the hydrajetting tool into the first region of the subterranean formation further comprises taking returns through the annulus; and flowing fluid continuously through the annulus into at least one of the one or more perforation tunnels in the first region at a pressure greater than the fracture closure pressure, so as to create one or more fractures in the first region comprises:

flowing fluid continuously through the annulus into at least one of the one or more perforation tunnels in the first region while restricting a flow of the returns through the annulus, so as to create one or more fractures in the first region; and injecting fluid into the annulus and into at least one of the one or more perforation tunnels in the first region as soon as the one or more fractures have been created, to enhance at least one of the one or more fractures.

10. The method of claim 1, wherein flowing fluid continuously through the annulus into at least one of the one or more perforation tunnels in the second region at a pressure greater than the fracture closure pressure comprises injecting fluid into at least one of the one or more perforation tunnels in the second region through both the hydrajetting tool and through the annulus.

11. The method of claim 1 wherein:

injecting a fluid through the hydrajetting tool into the second region of the formation further comprises taking returns through the annulus; and flowing fluid continuously through the annulus into at least one of the one or more perforation tunnels in the second region at the pressure greater than the fracture closure pressure, so as to create one or more fractures in the second region comprises:

flowing fluid continuously through the annulus into at least one of the one or more perforation tunnels in the second region while restricting a flow of the returns through the annulus, so as to create one or more fractures in the second region; and injecting fluid into the annulus and into at least one of the one or more perforation tunnels in the second region as soon as the one or more fractures have been created, to enhance at least one of the one or more fractures.

12. The method of claim 1, further comprising moving the hydrajetting tool to the second region simultaneously with the step of plugging at least partially at least one of the one or more fractures in the first region with the isolation fluid.

13. A method of completing a well in a subterranean formation, comprising:

providing a hydrajetting tool disposed within a well bore in the subterranean formation;

perforating a first region in the subterranean formation by injecting a pressurized fluid through the hydrajetting tool into the subterranean formation, so as to form one or more perforation tunnels in the first region;

initiating one or more fractures in the first region by injecting a fracturing fluid into at least one of the one or more perforation tunnels in the first region through the hydrajetting tool;

pumping additional fracturing fluid into at least one of the one or more fractures in the first region through an annulus between an outer surface of the hydrajetting tool and a wall of the well bore, so as to propagate at least one of the one or more fractures in the first region, wherein the additional fracturing fluid is pumped continuously through the annulus as soon as the one or more fractures are initiated;

moving the hydrajetting tool up hole simultaneously with pumping additional fracturing fluid into at least one of the one or more fractures in the first region while substantially simultaneously perforating a second region in the subterranean formation by injecting a pressurized fluid through the hydrajetting tool into the subterranean formation, so as to form one or more perforation tunnels in the second region;

initiating one or more fractures in the second region by injecting a fracturing fluid into at least one of the one or more perforation tunnels in the second region through the hydrajetting tool;

pumping additional fracturing fluid into at least one of the one or more fractures in the second region through the annulus between the outer surface of the hydrajetting tool and the wall of the well bore, so as to propagate at least one of the one or more fractures in the second region, wherein the additional fracturing fluid is pumped continuously through the annulus as soon as the one or more fractures are initiated; and moving the hydrajetting tool up hole simultaneously with pumping additional fracturing fluid into at least one of the one or more fractures in the second region.

14. The method of claim 13, wherein pumping additional fracturing fluid into at least one of the one or more fractures in the second region through the annulus between the outer surface of the hydrajetting tool and the wall of the well bore so as to propagate at least one of the one or more fractures in the second region is performed simultaneously with initiating one or more fractures in the second region by injecting a fracturing fluid into at least one of the one or more perforation tunnels in the second region through the hydrajetting tool.

15. The method of claim 13, wherein:

pumping additional fracturing fluid into at least one of the one or more fractures in the first region through the annulus between the outer surface of the hydrajetting tool and the wall of the well bore so as to propagate at least one of the one or more fractures in the first region is discontinued once the one or more perforation tunnels in the second region have been formed; and pumping additional fracturing fluid into at least one of the one or more fractures in the second region through the annulus between the outer surface of the hydrajetting tool and the wall of the well bore so as to propagate at least one of the one or more fractures in the second region occurs only after the one or more fractures in the second region have been formed.

16. The method to claim 13, further comprising pumping an isolation fluid down the annulus, wherein pumping the isolation fluid down the annulus is performed simultaneously with perforating the second region in the subterranean formation by injecting a pressurized fluid through the hydrajetting tool into the formation, so as to form one or more perforation tunnels in the second region.

17. The method of claim 13, wherein:

pumping additional fracturing fluid into at least one of the one or more fractures in the first region through the annulus between the outer surface of the hydrajetting tool and the wall of the well bore comprises pumping additional fracturing fluid into at least one of the one or more fractures in the first region through both the hydrajetting tool and the annulus; and pumping additional fracturing fluid into at least one of the one or more fractures in the second region through the annulus between the outer surface of the hydrajetting tool and the wall of the well bore comprises pumping additional fracturing fluid into at least one of the one or more fractures in the second region through both the hydrajetting tool and the annulus.

18. A method of completing a well in a subterranean formation, comprising:

providing a hydrajetting tool disposed within a well bore in the subterranean formation;

perforating a first region of the subterranean formation by injecting a perforating fluid through the hydrajetting tool into the subterranean formation, so as to form one or more perforation tunnels in the first region;

initiating one or more fractures in the one or more perforation tunnels in the first region by pumping a fracturing fluid through the hydrajetting tool;

injecting additional fracturing fluid into at least one of the one or more fractures in the first region through both the hydrajetting tool and an annulus between an outer surface of the hydrajetting tool and a wall of the well bore, so as to propagate the one or more fractures in the first region, wherein the additional fracturing fluid is injected continuously through the annulus as soon as the one or more fractures are initiated;

perforating a second region of the subterranean formation by injecting the perforation fluid through the hydrajetting tool into the subterranean formation, so as to form one or more perforation tunnels in the second region;

fracturing the second region by injecting fracturing fluid into at least one of the one or more perforation tunnels in the second region; and pumping a sufficient quantity of fracturing fluid into the well bore while fracturing the second region to at least partially plug at least one of the one or more fractures in the first region.

* * * * *